US011591776B2

(12) United States Patent
Hageman et al.

(10) Patent No.: US 11,591,776 B2
(45) Date of Patent: Feb. 28, 2023

(54) EARTH-MOVING MACHINE SENSING AND CONTROL SYSTEM

(71) Applicant: Deere & Company, Moline, IL (US)

(72) Inventors: John M. Hageman, Dubuque, IA (US); Tarik Loukili, Johnston, IA (US); Lacy Scott Bayless, Wamego, KS (US); Mathew J. Zeringue, Thibodaux, LA (US); Chad M. Indovina, Baton Rouge, LA (US); Suraj Amatya, Clive, IA (US); Cody R. Gros, Thibodaux, LA (US)

(73) Assignee: Deere & Company, Moline, IL (US)

( * ) Notice: Subject to any disclaimer, the term of this patent is extended or adjusted under 35 U.S.C. 154(b) by 982 days.

(21) Appl. No.: 16/384,425

(22) Filed: Apr. 15, 2019

(65) Prior Publication Data

US 2020/0325655 A1 Oct. 15, 2020

(51) Int. Cl.

| | |
|---|---|
| ***E02F 9/20*** | (2006.01) |
| ***E02F 9/26*** | (2006.01) |
| ***E02F 3/348*** | (2006.01) |
| ***E02F 7/04*** | (2006.01) |
| ***E02F 3/65*** | (2006.01) |

(52) U.S. Cl.

CPC ..... *E02F 9/26* (2013.01); *E02F 3/3486* (2013.01); *E02F 3/652* (2013.01); *E02F 7/04* (2013.01)

(58) Field of Classification Search

CPC ..... E02F 9/26; E02F 3/32; E02F 3/435; E02F 9/20; E02F 9/24; E02F 3/3486; E02F 3/652; E02F 7/04; E02F 3/651; E02F 3/961; E02F 9/265; E02F 3/6454

See application file for complete search history.

(56) References Cited

U.S. PATENT DOCUMENTS

| | | | | |
|---|---|---|---|---|
| 5,529,537 | A | 6/1996 | Johnson | |
| 7,458,428 | B2 | 12/2008 | Laudick et al. | |
| 7,665,285 | B1 * | 2/2010 | Harada | A01D 43/0631 56/16.6 |

(Continued)

FOREIGN PATENT DOCUMENTS

| | | | |
|---|---|---|---|
| BR | 102019000830 | A2 | 7/2020 |
| CN | 201528545 | U | 7/2010 |

(Continued)

OTHER PUBLICATIONS

Application and Drawings for U.S. Appl. No. 17/585,186, filed Jan. 26, 2022, 141 pages.

(Continued)

*Primary Examiner* — Edwin J Toledo-Duran

(74) *Attorney, Agent, or Firm* — Christopher J. Volkmann; Kelly, Holt & Christenson, PLLC

(57) ABSTRACT

An example work machine control system includes target fill level determination logic configured to determine a target fill level for a container of an earth-moving work machine, fill level measurement logic configured to receive a sensor signal from a sensor that detects contents of the container and generate a measurement metric indicative of a current fill level of the container based on the sensor signal, and control logic configured to generate a machine control signal based on the measurement metric and the target fill level.

16 Claims, 16 Drawing Sheets

(56) References Cited

U.S. PATENT DOCUMENTS

| | | | | |
|---|---|---|---|---|
| 7,832,126 | B2 * | 11/2010 | Koellner | E02F 9/262 37/348 |
| 8,170,756 | B2 * | 5/2012 | Morey | E02F 3/6436 340/988 |
| 8,229,631 | B2 * | 7/2012 | Morey | E02F 3/651 701/50 |
| 9,605,994 | B2 * | 3/2017 | Jensen | G01G 19/64 |
| 10,701,861 | B2 | 7/2020 | Gould et al. | |
| 10,733,752 | B2 * | 8/2020 | Hageman | G01F 22/00 |
| 11,308,738 | B2 * | 4/2022 | Thomas | G07C 5/0825 |
| 2008/0005938 | A1 * | 1/2008 | Aebischer | E02F 9/264 73/32 R |
| 2008/0162004 | A1 * | 7/2008 | Price | G05D 1/0251 701/50 |
| 2009/0002187 | A1 * | 1/2009 | Kriel | G01G 23/38 340/679 |
| 2009/0084173 | A1 * | 4/2009 | Gudat | G01S 13/88 73/146 |
| 2010/0245542 | A1 * | 9/2010 | Kim | G01B 11/00 37/444 |
| 2010/0332051 | A1 | 12/2010 | Kormann | |
| 2012/0136542 | A1 * | 5/2012 | Upcroft | E02F 9/26 701/50 |
| 2013/0329012 | A1 * | 12/2013 | Bartos | G06T 7/80 348/46 |
| 2013/0346127 | A1 * | 12/2013 | Jensen | G06Q 10/06 701/1 |
| 2016/0059854 | A1 * | 3/2016 | Ohsugi | B60W 30/085 701/50 |
| 2017/0328030 | A1 * | 11/2017 | Yamada | E02F 9/262 |
| 2018/0035603 | A1 * | 2/2018 | Kremmer | A01C 7/20 |
| 2018/0120098 | A1 * | 5/2018 | Matsuo | E02F 9/26 |
| 2018/0174291 | A1 * | 6/2018 | Asada | G06T 7/0002 |
| 2018/0245308 | A1 * | 8/2018 | Ready-Campbell | G05D 1/0274 |
| 2018/0340316 | A1 * | 11/2018 | Izumikawa | E02F 9/16 |
| 2019/0026914 | A1 * | 1/2019 | Hageman | G01B 11/26 |
| 2019/0166761 | A1 | 6/2019 | Conrad et al. | |
| 2020/0180493 | A1 * | 6/2020 | Thompson | B65G 65/32 |
| 2020/0325653 | A1 | 10/2020 | Hageman et al. | |
| 2021/0195840 | A1 | 7/2021 | Puryk et al. | |

FOREIGN PATENT DOCUMENTS

| | | | |
|---|---|---|---|
| CN | 102564528 | A | 7/2012 |
| CN | 104247607 | B | 12/2014 |
| CN | 109392426 | A | 1/2019 |
| EP | 2359674 | B1 | 8/2011 |
| EP | 3448145 | B1 | 3/2019 |
| EP | 3448144 | B1 | 2/2020 |

OTHER PUBLICATIONS

Application and Drawings for U.S. Appl. No. 17/584,986, filed Jan. 26, 2022, 58 pages.

Application and Drawings for U.S. Appl. No. 17/584,966, filed Jan. 26, 2022, 143 pages.

* cited by examiner

EARTH-MOVING MACHINE SENSING AND CONTROL SYSTEM

FIELD OF THE DESCRIPTION

The present description relates to devices for use in earth-moving operations. More specifically, but not by limitation, the present description relates to a material sensing and control system for an earth-moving machine.

BACKGROUND

Many earth-moving operations utilize an earth-moving work vehicle or machine (such as a scraper, excavator, loader, dump truck, etc.) that receives earth to be moved into a bucket, container, or other accumulator having a maximum capacity based on a rated volume and/or weight. In one example, a towed scraper utilizes a height-adjustable blade that scrapes earth into the bucket. The blade is manually controlled by an operator of a towing vehicle as the machine traverses the ground.

Operating a scraper, or other earth-moving work vehicle or machine, is a highly personal skill. The tasks require an operator with considerable experience and skill and a high level of concentration to operate at an acceptable level of productivity and performance. Further, efficiency (e.g., the amount of earth moved by the work vehicle over an amount of time or per unit of fuel consumed, etc.) is one way to measure at least part of that skill. Efficiency is also one way to measure the performance of the particular machine.

The discussion above is merely provided for general background information and is not intended to be used as an aid in determining the scope of the claimed subject matter.

SUMMARY

An example work machine control system includes target fill level determination logic configured to determine a target fill level for a container of an earth-moving work machine, fill level measurement logic configured to receive a sensor signal from a sensor that detects contents of the container and generate a measurement metric indicative of a current fill level of the container based on the sensor signal, and control logic configured to generate a machine control signal based on the measurement metric and the target fill level.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The present description relates to devices for use in earth-moving operations. More specifically, but not by limitation, the present description relates to a material sensing and control system for an earth-moving machine. One example of an earth-moving machine comprises a towed scraper pulled by a towing vehicle, such as a tractor.

However, it is noted that examples described herein can be implemented using any type of earth-moving vehicle or machine, such as an excavator or scraper. These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

For example, while this disclosure describes measuring contents in the container or accumulator of a scraper, the contents could be in the container of any capable work machine, such as a front loader, a scraper, loader, dump truck below-ground mining equipment, or other type of machine, etc. Further, while examples are described in context of a towed scraper, that is towed by a towing vehicle such as a tractor, in some applications a scraper is carried on a traction or propulsion machine. For instance, a tractor can have integrated scraper features.

Figure 1:
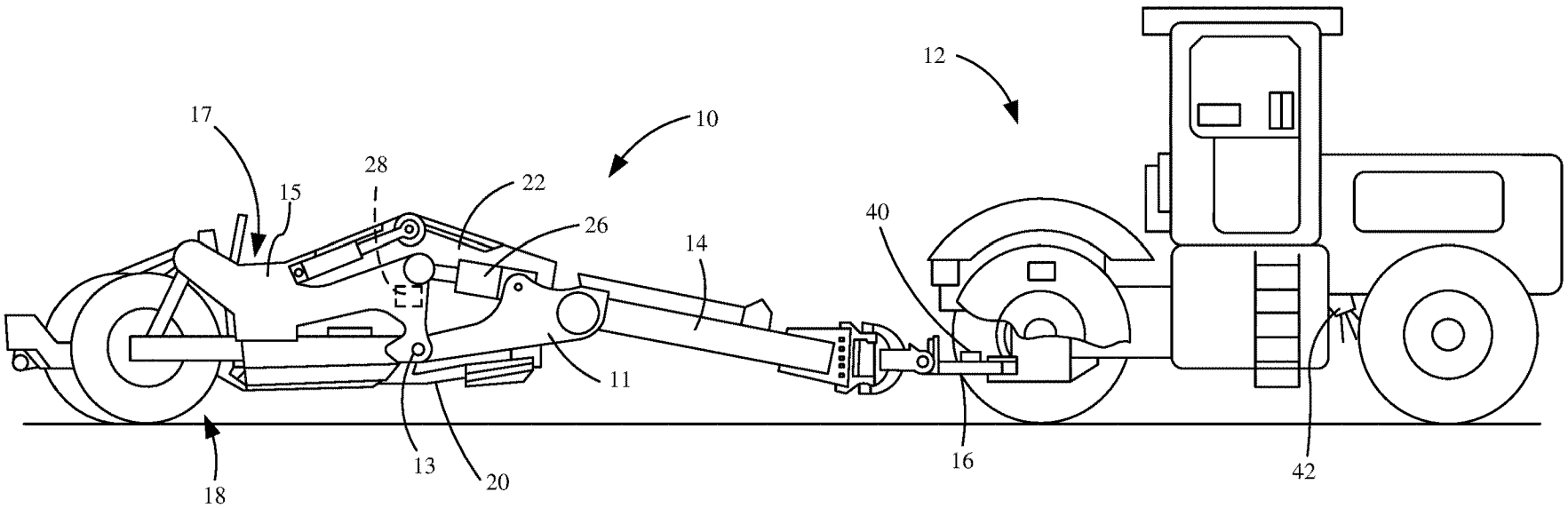
FIG. 1 is a simplified side view of one example of an earth-moving work machine towed by a towing machine.

FIG. 1 illustrates one example a pull-type or towed scraper 10 that is towed by a towing vehicle 12, such as a conventional tractor. Scraper 10 includes a relatively fixed front frame 11 attached to a forward extending tongue 14 which is coupled to a drawbar 16 of the tractor 10. The scraper 10 also includes a rear frame 15 which has an aft end supported by ground engaging wheels 18 and which is pivotally coupled to the front frame 11 at pivot 13.

Scraper 10 includes a container 17 and a cutting edge that can be raised or lowered to control the depth of the cut, and thus the rate at which the material is accumulated in container 17. As the scraper 10 moves along a surface, the cutting edge can scrape up earth and fill the container 17. In one example, the cutting edge comprises a blade 20 which projects from the bottom of a gate 22 which is fixed relative to rear frame structure 15.

Blade 30 is raised and lowered by one or more actuators (such as blade lift cylinders 26). A blade position sensor 28 on the scraper 10 senses the position or angle of the blade 20 with respect to the front frame 11. Gate 22 is movable by one or more actuators (such as hydraulic cylinder(s)) between an open position, in which container 17 receives scraped material from blade 30 and a closed position that prevents material from entering container 17. Scraper 10 also includes an ejector configured to eject the material from container 17 during a dumping operation.

A vehicle speed sensor 42 is mounted on the tractor 12. In one example, a draft force sensor 40 is mounted on an upper surface of a tractor drawbar 16, and is configured to detect the draft force of tractor 12 on scraper 10. Alternatively, the draft force sensor 40 could be mounted in an appropriate location on the scraper tongue 14.

Figure 2:
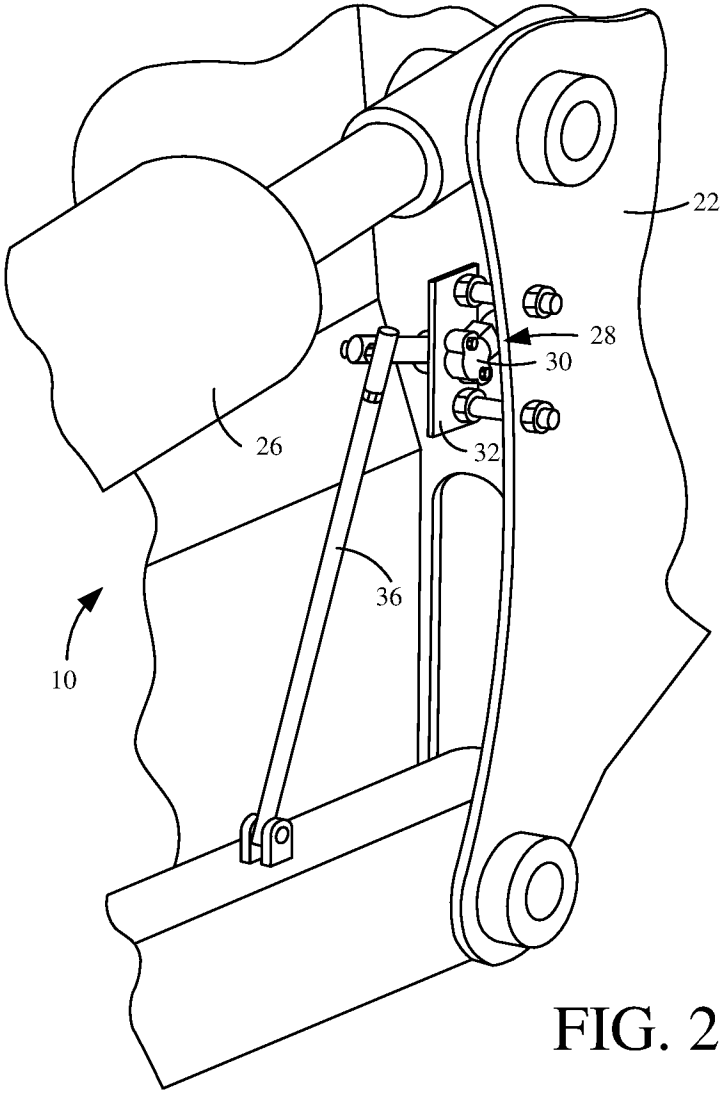
FIG. 2 is a perspective view of a blade position sensor which is mounted on a scraper, in one example.

FIG. 2 illustrates a portion of scraper 10. As shown, blade position sensor unit 28 includes a rotary position sensor 30 mounted on a plate 32 which is fixed to a part of the rear frame 15. A sensing arm 34 projects from the sensor 30, and a rod 36 connects the arm to a part (not shown) of the front frame 11. As the blade 20 and gate structure 22 move with respect to the front frame 11, the rod 36 pivots arm 34 which in turn imparts a rotary input to sensor 30. The blade 20 will be raised when cylinder 26 is extended and lowered when cylinder 26 is retracted.

Figure 3:
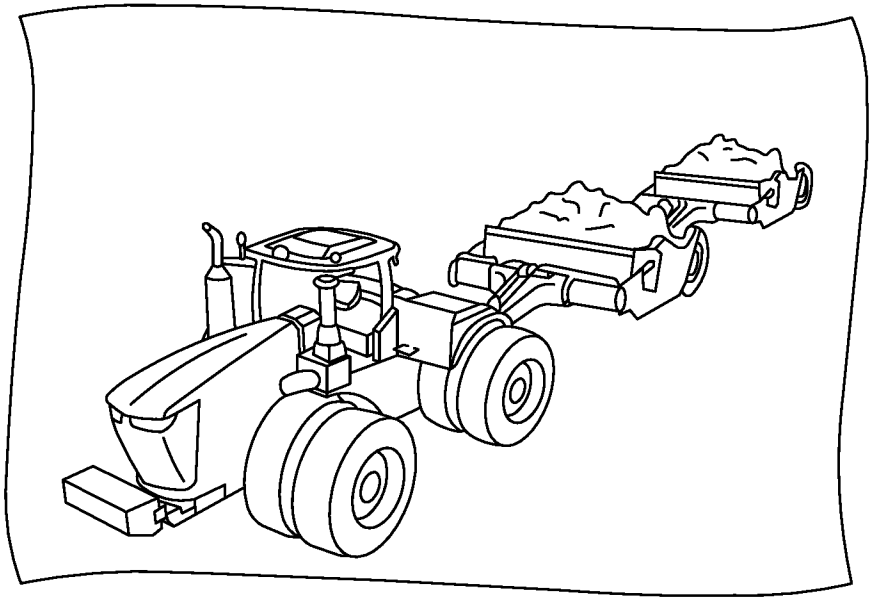
FIG. 3 is a perspective view of an example work machine system.

In one example, multiple scrapers can be towed by a towing vehicle. FIG. 3 illustrates one example of a towed (tandem in the illustrated example) arrangement wherein two (or more) scrapers are towed, one behind the other. In an example operation, when the front scraper is filled, its blade is lifted and the rear scraper blade then-continues the same cut as its blade reaches the end of the cut made by the front scraper.

In an example earth moving operation with a towed (e.g., tractor-drawn) scraper, the depth of cut of the scraper is manually controlled by an operator as the machine traverses the ground. In an attempt to improve operating efficiency, experienced operators will feather the depth of cut to prevent clutching, tractor stall or wheel slip during use. Additionally, it is often difficult for an operator to properly adjust blade position or depth at the start of, or during, a scraping operation. Further, it is often difficult for the operator to know when the scraper container or container is at or nearing the rated capacity of the scraper. This often results in the operator raising the blade and/or closing the gate too soon, or too late. The former results in an under-filled container, which requires additional passes over the terrain being scrapped, and decreases efficiency (e.g., increased fuel-consumption, increased time required, increased wear and tear on the machine. The latter, on the other hand, also can result in decreased efficiency. For instance, as an over-filled scraper continues its pass along the terrain, the blade pushes the earth off to the side rather than into the over-filled accumulator and/or earth is spilled from the over-filled accumulator. Further, an over-filled scraper also causes undesired fuel consumption and wear and tear on the towing machine (e.g., tires, engine, etc.) and/or the towed scraper itself.

As can be seen, these tasks require an operator with considerable experience and skill and a high level of concentration to operate at an acceptable level of productivity and performance.

Certain examples and features of the present disclosure related to a sensing and control system for an earth-moving machine. In described examples, the system detects a target fill level for the scraper. This can be done manually, automatically, or semi-automatically. As the scraper traverses the terrain during a scraping operation, the system detects the actual fill level of the scraper and generates control outputs for controlling the scraper and/or towing vehicle. For instance, the system can automatically control functionality of the scraper blade, scraper gate, and/or propulsion system of the towing vehicle. Alternatively, or in addition, the system can control input/output devices in the operator compartment of the towing vehicle, to guide or otherwise assist the operator in controlling the towing vehicle and scraper. For instance, the control system can automatically control user interface mechanisms, such as steering wheels, levers, pedals, display devices, user interfaces, etc. For example, when an operator interacts with a user interface mechanism, control logic can generate a control signal to perform the operator indicated action.

Further, the productivity of material moved by a work vehicle or a group of work vehicles at a work site can be monitored. Volume sensors can be used to improve volume estimation accuracy and ease. Costs and inconvenience can be reduced, as compared to other volume estimation solutions, such as position sensors and weighting sensors.

In some examples, the performance of the work vehicle operator can be measured by recording the total volume of the material moved throughout the operation and generating a histogram of the measured volume of the material. In addition or alternatively, volume estimation metrics and visualizations can be displayed as one or more of (i) a 3D point cloud of the container, material, and the surrounding environment, (ii) images from the stereo camera, or (iii) metrics, such as volume estimation, variance, totals, container position, container velocity, etc.

Figure 4:
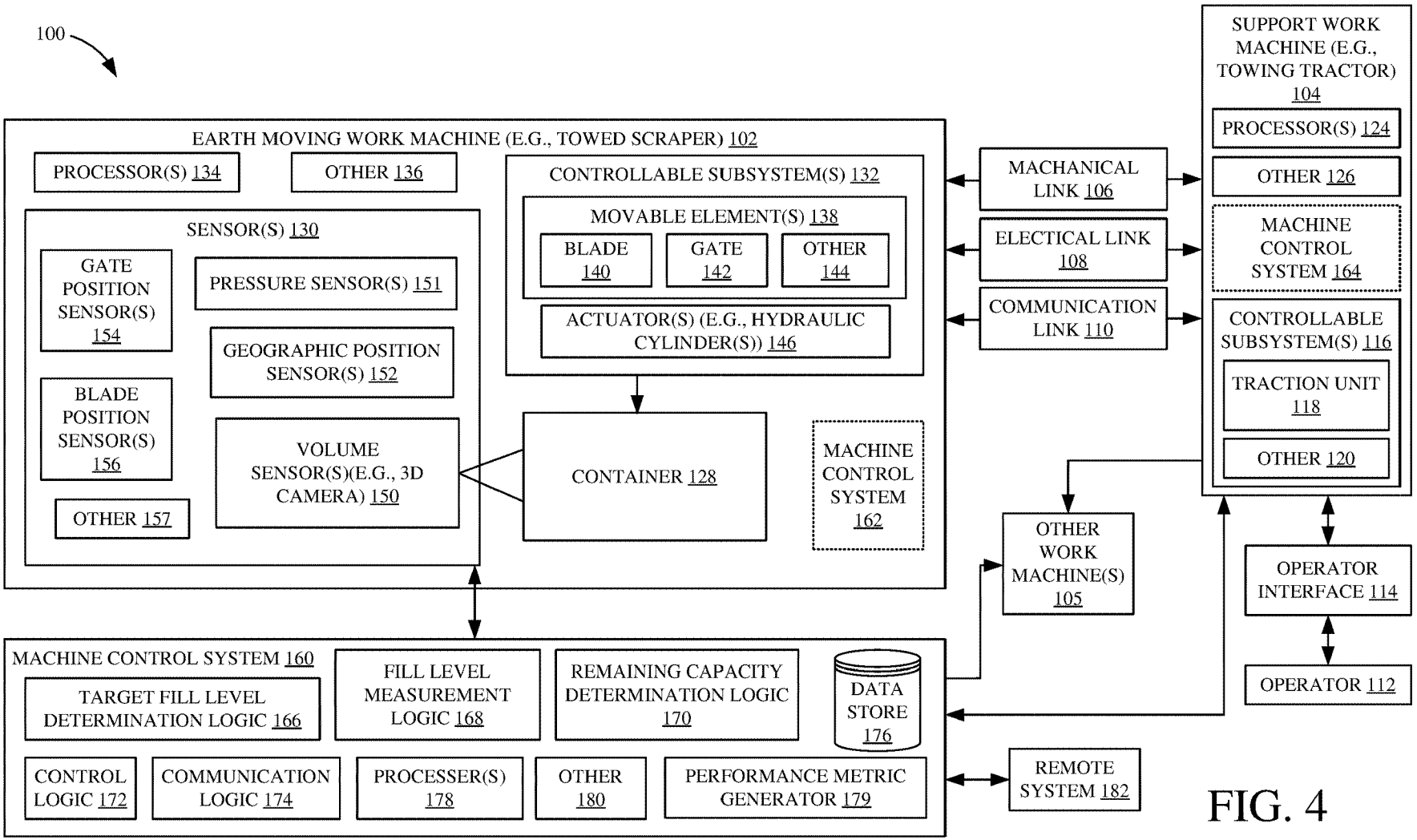
FIG. 4 is a block diagram of one example of a work machine system that includes material sensing and machine control features.

FIG. 4 is a block diagram of one example of a work machine system 100 that includes material sensing and machine control features. As shown, system 100 includes at least one earth-moving work machine 102. Illustratively, work machine 102 comprises a towed scraper, such as scraper 10 illustrated in FIG. 1, that is towed by a support work machine 104, such as a towing tractor, across a terrain to collect and move earth material. Machines 102 and 104 are connected by one or more links, such as mechanical link(s) 106, electrical link(s) 108, and communication link(s) 110. Support work machine 104 is controlled by an operator 112 through an operator interface 114, such as in an operator compartment or cab. Machine 104 includes controllable subsystems 116, that can be controlled by operator 112, such as a traction or propulsion unit 118. Unit 118 includes any suitable propulsion system, such an engine with a transmission that drives ground-engaging mechanisms (such as wheels, tracks, etc.) to propel machine 104, and thus machine 102, through mechanical link(s) 106. Controllable subsystems 116 can include other controllable systems as well. This is represented by block 120.

Machine 104 can also include user interface mechanism(s) 122, one or more processor(s) 124, and can include other items 126 as well. Mechanism(s) 122 include both input and output mechanisms, and be a wide variety of user interface components that allow a user to interface with the other portions of machines 102 and/or 104. For instance, they can include levers, switches, wheels, joysticks, buttons, a steering wheel, pedals, etc. They can also include microphones with speech recognition systems and natural language processing systems, to process speech inputs. They can include user input mechanisms that can be actuated from a user interface display. For instance, they can be icons, links, drop down menus, radio buttons, text boxes, or a wide variety of other user input mechanisms that can be actuated by a user, on a user interface display screen.

Further, machine 104 can be coupled to (e.g., mechanically, electrically, and/or communicatively), and configured to tow, one or more other earth moving work machines 105, such as in a tandem configuration shown in FIG. 3.

Of course, as noted above, in other examples earth-moving work machine 102 can be self-propelled. That is, it is not towed by a towing vehicle, but is self-propelled (e.g., it includes its own traction unit and corresponding operator controls).

Work machine 102 includes a container 128 configured to accumulate and carry earth material, sensor(s) 130, controllable subsystem(s) 132, processor(s) 134, and can include other items as well, as indicated by block 136. As illustrated, controllable subsystem(s) include movable elements 138, which include a blade 140, a gate 142, and include other items 144. Movable elements 138 can be moved by one or more actuators 146, such as hydraulic cylinders or other types of actuators. Examples of blade 140 and gate 142, and corresponding actuators, are described above with respect to FIG. 1.

Sensors 130 can include one or more of a volume sensor 150, a pressure sensor 151, a geographic position sensor 152, a gate position sensor 154, a blade position sensor 156, and can include other sensors as well, as indicated by block 157.

Volume sensor(s) 150 are configured to sense contents in container 128, for use in determining a current volume of the material in container 128.

An example volume sensor includes, but is not limited to, a three-dimensional (3D) sensor, such as a stereo camera or a laser scanner, that captures images (or data) of contents in container 128 that are, at least in part, indicative of a volume of the contents. In one example, 3D sensor 150 includes a lidar array that senses heights and volumes of points that correspond with the contents in container 128.

As discussed in further detail below, to sense the volume, one example process includes measuring 3D points, with the 3D sensor, that represent the surface of material carried by the container of a work machine. Briefly, the 3D points that correspond to the material carried by the container can be processed to generate a 3D point cloud that is compared to 3D points (or other model) that correspond to the container 128, to determine a volume of the contents.

In other examples, the sensor can be a different type of sensor (e.g., a fixed, scanning, or flash laser mounted on the work vehicle) that can use time-of-flight principles to capture the 3D points.

In one example, the volume of material can be calculated using the 3D points corresponding to the material carried by the container using (i) the orientation or location of the carrier relative to the sensor and (ii) a 3D shape of the container. For example, the volume can be calculated as a difference in the surface of the material in container 128 from a reference surface (e.g., the container interior) that represents a known volume.

In one example, pressure sensors 151 are coupled to one or more actuators 146 to sense a pressure in an actuator 146. A weight of contents in the container 128 can be accurately calculated with pressure sensor(s) 151 by knowing some machine parameters. For instance, to sense a weight, the weight sensor can determine a hydraulic pressure required to support the container 128 and its contents. The hydraulic pressure typically is indicative of the total weight supported by the hydraulic cylinder. However, since the machine components have known weights and geometries they can be factored out of the total weight resulting in a reliable weight of the contents in container 128.

Geographic position sensor 152 is configured to generate a signal indicative of a geographic location of machine 102. As discussed in further detail below, this position can be correlated to the scraping operation that collects earth material in container 128. Examples of sensor 152 include, but are not limited to, a global positioning system (GPS) receiver, a LORAN system, a dead reckoning system, a cellular triangulation system, or other positioning system.

Gate position sensor 154 is configured to sense a position of gate 142, and blade position sensor 156 is configured to sense a position of blade 140, which is indicative of a depth of a cut being made by machine 102.

System 100 also includes a machine control system 160 comprising sensing functionality configured to sense operational characteristics of machines 102 and/or 104, and control functionality configured to control machines 102 and/or 104 based on those operational characteristics. It is noted that machine control system 160 is illustrated in FIG. 4 in dashed lines to indicate that one or more components of system 160 can be disposed on machine 102. This is indicated by corresponding block 162. Alternatively, or in addition, one or more components of system 162 can be disposed on machine 104. This is indicated by corresponding block 164.

Machine control system 160 includes target fill level determination logic 166, a fill level measurement logic 168, remaining capacity determination logic 170, control logic 172, communication logic 174, a data store 176, one or more processors 178, a performance metric generator 179, and can include other items 180 as well.

Briefly, control logic 172 is configured to control one or more of controllable subsystem(s) 132 and 116, and communication logic 174 is configured to communicate with other systems/machines. For instance, using communication logic 174, machine control system 160 can communicate with machine 102, machine 104, machine(s) 105, and/or a remote system 182. Data store 176 can store machine parameters, such as, but not limited to, characteristics of machine 102 including maximum capacity information for container 128. Data store 176 can also include operational parameters, such as geo-referenced material data that represents past scraping operation(s). Fill level measurement logic 168 is configured to measure a current fill level of (e.g., volume of contents in) container 128, based on signals from sensor(s) 160.

Fill level measurement logic 168 estimates a volume of material (e.g. earth) in container 128 using a non-contact measurement system. The system includes 3D sensor 150, such as a stereo camera (which may be referred to as a stereoscopic camera) or a laser scanner. The 3D sensor 150 can capture images of the contents of container 128. The images can be converted to a 3D point cloud, which is compared to a known point cloud, mathematical model, or CAD model representing container 128 and different volumes of contents to determine the volume of content in container 128.

Figure 5:
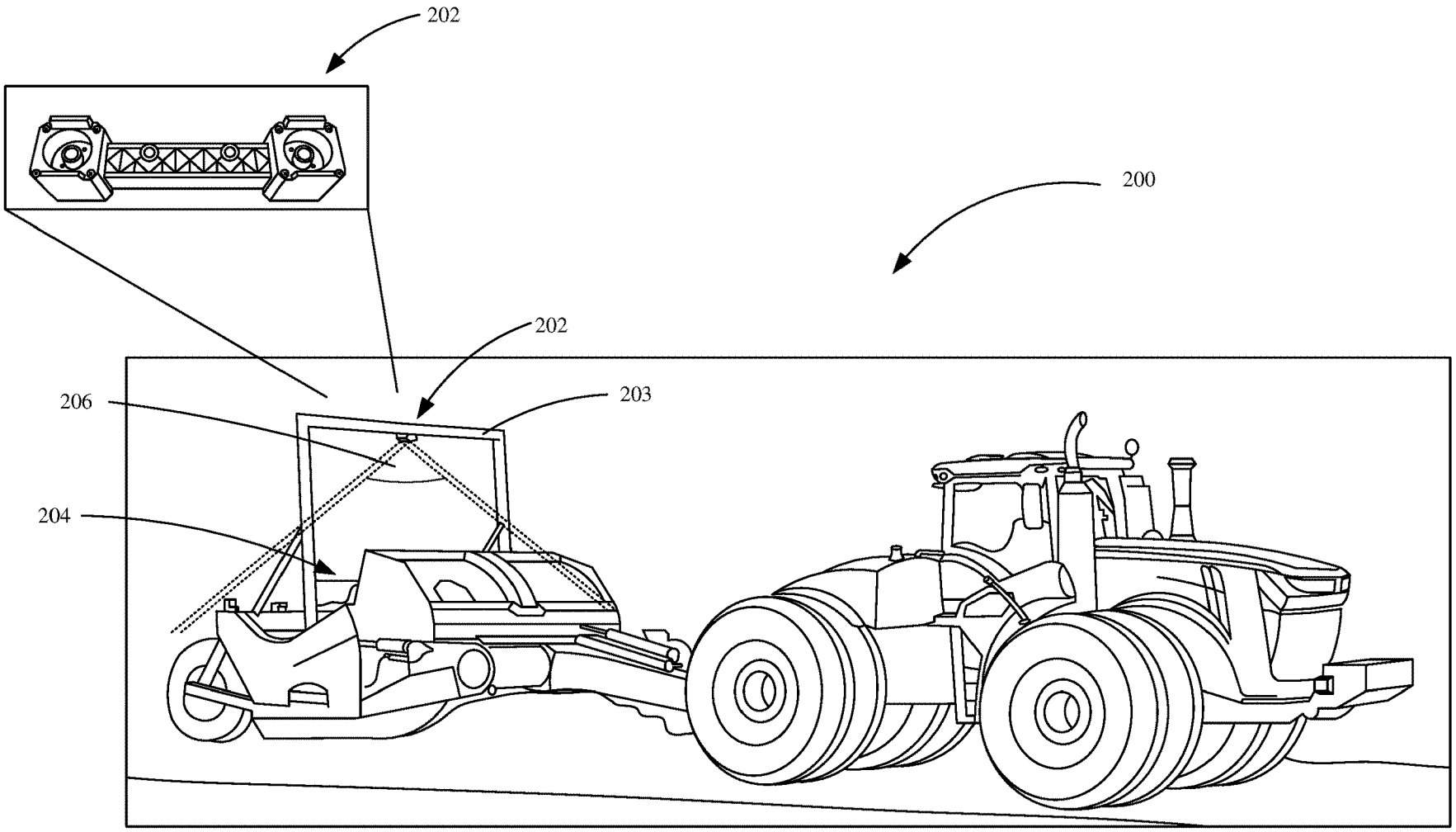
FIG. 5 is a perspective view of one example of a scraper including a volume sensor.
Figure 6:
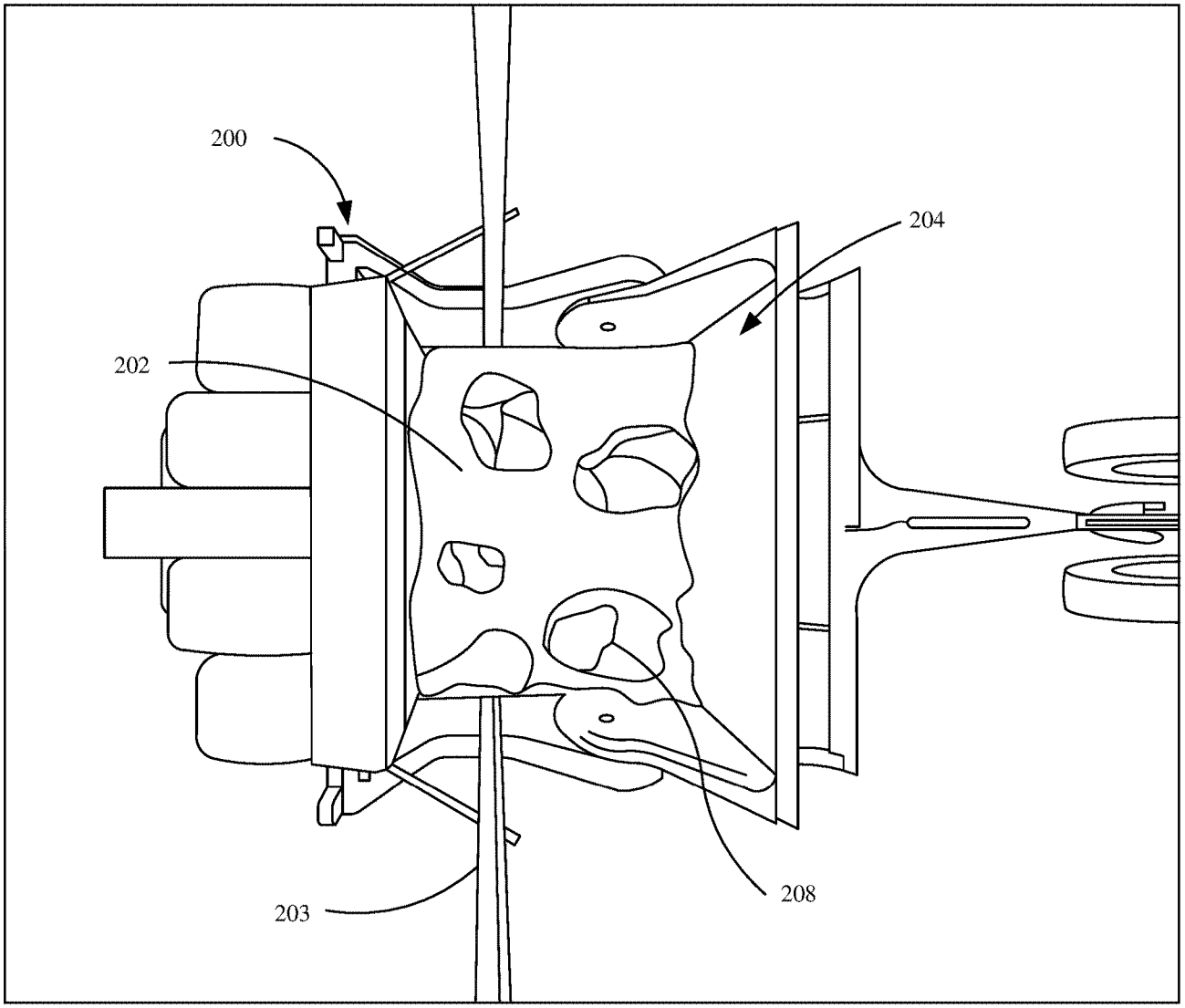
FIG. 6 is a top view of the example scraper shown in FIG. 5.
Figure 7:
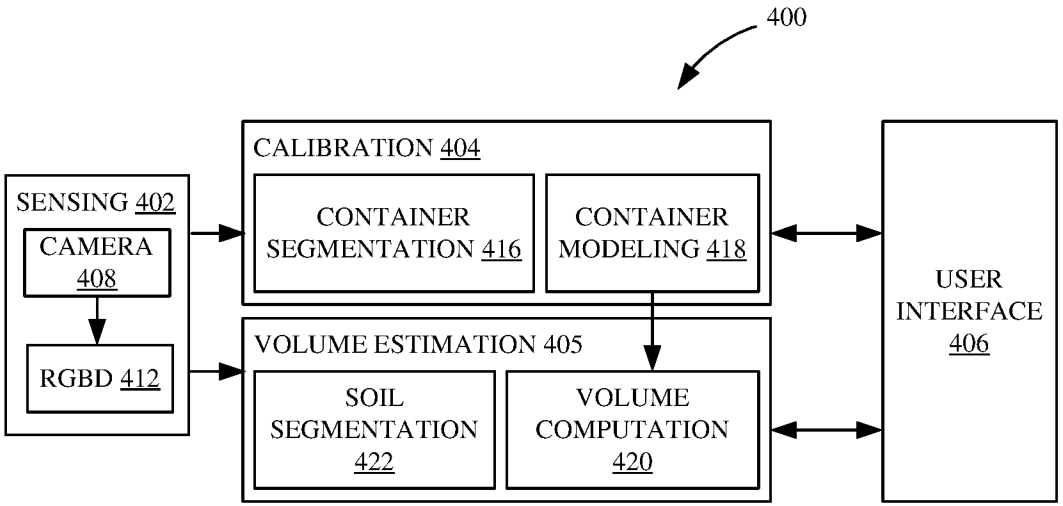
FIG. 7 is a functional block diagram of one example of a volume estimation system.

In one example, the volume estimation system includes the stereo camera mounted with the container of the earth-moving work machine in its field of view. One example is shown in FIGS. 5 and 6. As illustrated in FIG. 5, which is a perspective view of a towed scraper 200, a stereo camera 202 is mounted on a support frame 203 with the contents of a container 204 of scraper 200 in the field of view 206 of camera 202. This is illustrated in FIG. 6, which is a top view of container 204. Stereo camera 202 can be used to create a 3D point cloud of objects in the field of view of the stereo camera. The volume of the material 208 can be estimated using various processes.

Referring again to FIG. 4, the system can measure 3D points that represent the surface of material carried by container 128, which includes determining which surface is above container 128 that is likely to be soil. The surface of the soil can be compared to the model of container 128 to determine the amount of material in container 128 and produce a volume estimation measurement substantially contemporaneously with container 128 moving the soil. The data, along with other metrics, can be displayed to operator 112 or sent to remote system 182, such as cloud service (e.g., JDLink™), for an owner or manager to view.

In some examples, the surface of the material can be extrapolated when the material is unobservable by the non-contact sensor by measuring an angle of repose of the material. The 3D points may also include other surfaces both within the container 128 and the surrounding environment that is within the field of view of the sensor. The 3D points that correspond to the material carried by container 128 can be determined and the 3D points that correspond to the container itself can be determined. The 3D points that do not correspond to material carried by the container or the container itself can be filtered out. For example, 3D points representing dust or other airborne obscurerants can be filtered out. For example, the volume can be calculated as a difference from a reference surface that represents a known volume. Other sensor inputs, such as position, speed, and pressure, from sensors on the work vehicle can also be used.

The system can differentiate between the material carried by the container and other material or objects using the appearance (such as from color data) and the location of the 3D points. Filtering out non-container and non-carried material can use both a depth image of the field of view and the appearance of the images captured by the stereo camera. The geometry of the shape of the container can be modeled. One process to model the shape of the carrier includes measuring by the sensor the 3D points that correspond to the container when the container is empty—i.e., there is no material in the container—such as through a calibration process. The 3D points are filtered to determine the boundaries of the container. A mathematical representation of the container is generated by processing the measured 3D points. Segments of the 3D points corresponding to various geometric components of container 128 are generated. Examples of segments include a back plate, side sheets, an inner surface, for container 128. The model can also be generated using a 3D CAD drawing of the container. Each of the geometric components of the container can be determined by the appearance and relative position and orientation with reference to the sensor, of the respective geometric component. The geometry of the shape of the container can be modeled from an onboard or off-board storage device.

Performance metric generator 179 is configured to run performance analysis on the data generated by system 100, and to generate performance metrics or scores, which can be indicative of performance (e.g., productivity, efficiency, etc.) of machines 102 and/or 104, and/or of operator 112. The performance metrics can be generated on a per-load basis (e.g., an individual pass), a per-project basis (e.g., multiple passes), or otherwise.

In one example, generator 179 obtains raw data from a plurality of machine sensors, along with a plurality of environment sensors. Raw data can also be obtained from other machine data sources. By way of example, machine sensors can include a wide variety of different sensors that sense operating parameters and machine conditions on machines 102 and/104. For instance, they can include speed sensors, mass flow sensors, various pressure sensors, pump displacement sensors, engine sensors that sense various engine parameters, fuel consumption sensors, among a wide variety of other sensors. Environment sensors can also include a wide variety of different sensors that sense different things regarding the environment of machine 102.

One example performance metric measures productivity by volume and/or time, and can be generated in real-time, or substantially real-time. For instance, a performance metric can be generated based on a deviation of scraper load(s) from the target fill level (i.e., was the container over-filled or under-filled relative to the target volume). Further, this can be correlated to with fuel consumption to generate a measure of fuel efficiency relative to scraper productivity.

In one example, the performance metric indicates a deviation of fuel consumption from an expected or average fuel consumption for the machine, given the operational and environmental conditions (terrain level or slope, soil conditions, machine type, etc.).

Further, the performance data can be fed back to system 100, and used to adjust the operation, settings, or other control parameters for machines 102 and/or 104, on-the-fly, in order to improve the overall performance. It can also be used to display information to operator 112, indicating the performance scores, along with recommendations of how operator 112 should change the settings, control parameters, or other operator inputs, in order to improve the performance.

In one example, performance metric(s) are generated on a per-operator basis, and can be correlated and/or compared to other operators. A comparison component can compare derived data for operator 112 against reference data. The reference data can include a plurality of different reference data sets and it can also include user preferences. The reference data sets can be used to compare the derived data of operator 112 against the operator's historical derived data, against data for other operators in the same fleet as operator 112, or against another set of relevant reference data. The comparison component can provide an output indicative of that comparison, and a classifier component can classify that output into one of a plurality of different performance ranges (such as good, medium or poor, although these are exemplary and more, fewer, or different ranges can be used).

FIG. 4 is a functional block diagram of one example of a volume estimation system 400 for use in a work machine system. For sake of illustration, but not by limitation, system 400 will be described below in the context of system 100, illustrated in FIG. 4.

The volume estimation system 400 includes a sensing portion 402, a calibration portion 404, and a volume estimation portion 405, along with a user interface 406 for outputting data to a user or another system. In one example, the calibration portion 404 and/or the volume estimation portion 405 can be implemented by a processor device, such as processor 178 of FIG. 4. Further, volume estimation portion 405 can be implemented by fill level measurement logic 168. The sensing portion 402 includes a camera 408 or other type of sensor (e.g., volume sensor(s) 150) for capturing 3D images and data of a container (e.g., container 128) of an earth-moving work machine (e.g., machine 102). The camera 408 can provide multiple images of the container. The images can include color content, such as red, green, blue (RGB) content, and depth content (D). This is represented by block 412.

The image data, in color and with depth information, can be provided to the calibration portion 404 and the volume estimation portion 405. In some examples, the image data of the container without material in it can be provided only to the calibration portion 404, and image data acquired subsequently that includes images of the container with material in it can be provided only to the volume estimation portion 405.

The calibration portion 404 can generate a model of the container using the image data. The model can be in the form of a 3D point cloud that represents the components of the container, and may have information about volumes if material were at different levels in the container. The calibration portion 404 includes a container segmentation module 416 that can segment the image data to determine the components of the container and the positions of the container relative to each other. For example, the container segmentation module 416 can analyze pixel data in the images to identify the back of the container, and the front of the container, the sides of the container. That information can be provided to the container modeling module 418 that can generate the model of the container as a configuration file. The configuration file can have information about the container in a 3D point cloud arrangement. In general, the configuration file can store various parameters (e.g., container capacity, dimensions, mathematical model coefficients, etc.) regarding each component of the software. The configuration file can also be outputted via the user interface 406.

The model can be used by a volume computation module 420 in the volume estimation portion 405 to estimate a volume of material in the container. Image data can be received by a soil segmentation module 422, which can determine whether material represented in the image data is in the container or if it is in the background or another part of the image.

The image data representing material in the container can be provided to the volume computation module 420, which can compare that image data to the configuration file to output an estimate of the volume of the material in the container. The estimate of the volume can be provided to the user interface 406, which may be a display device that can output a visual representation of the volume estimation. In another example, the estimate is provided to control logic, such as control logic 174, for use in automated, or semi-automated, control of the machine.

Figure 8:
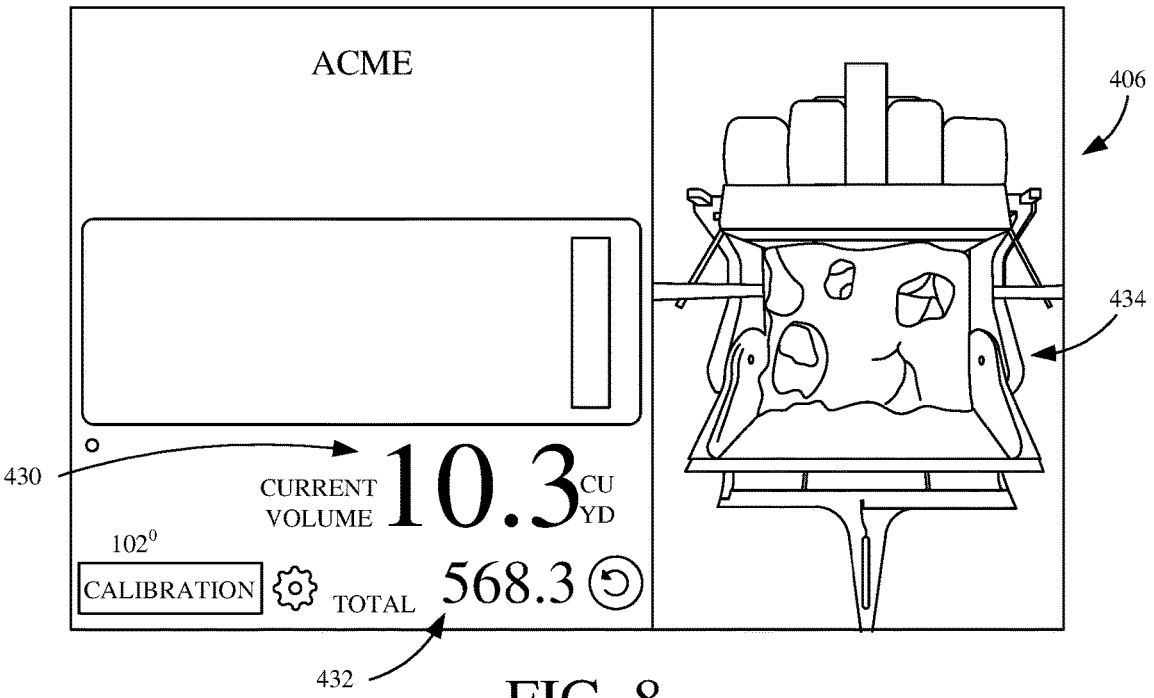
FIG. 8 illustrates an example user interface display.

FIG. 8 depicts an example of user interface 406 on a display device. The user interface 406 can include an indication 430 of the current volume of material in the container and an indication 432 of a total volume of material moved during a series of earth-moving operations (e.g., using machines in a current pass over a terrain and/or one or more previous passes). The user interface 406 can also including a representation 434 of the container, such as an image or video obtained from the camera and/or a three-dimensional representation of a point cloud or other depiction of the container.

Figure 9:
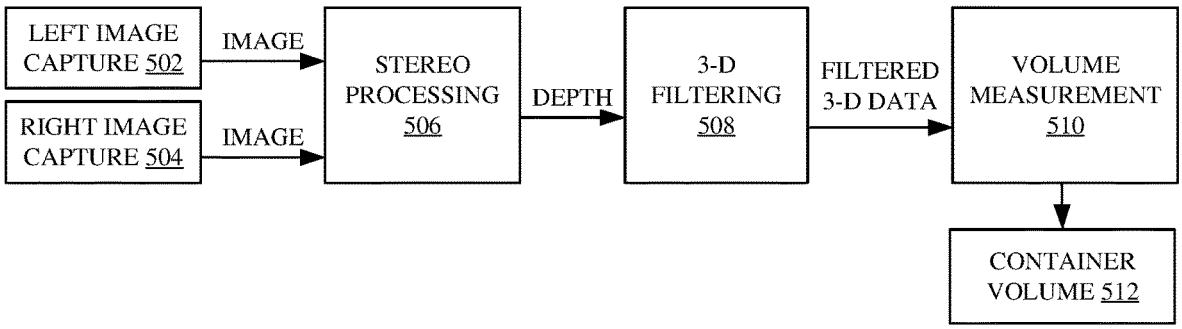
FIG. 9 is a process flow diagram for processing stereo images for measuring volume of material in a container, in accordance with one example.

FIG. 9 illustrates an example process for measuring the volume of material in a container using stereo images. A stereo camera can capture left-eye images 502 and right-eye images 504 of a field of view that includes a container with material. A processor device (e.g., processor 134 and/or processor 178) performs stereo processing 506 on the captured images to determine depth information representing by the left-eye images 502 and the right-eye images 504. For example, the images may be time stamped and a left-eye image and a right-eye image sharing the same time stamp can be combined to determine the depth information represented by the images.

The images and the depth information are filtered using a 3D filtering process 508. For example, the filtering process 508 can remove speckles that are flying points or debris in the area, or other visual representations of objects that are not within the container. The filtering process 508 can include performing a speckle reduction process on the images. The filtered 3D data is used to determine a volume measurement 510 of the contents within the container. The volume 512 can be outputted to a display device or to a database for storage.

Figure 10:
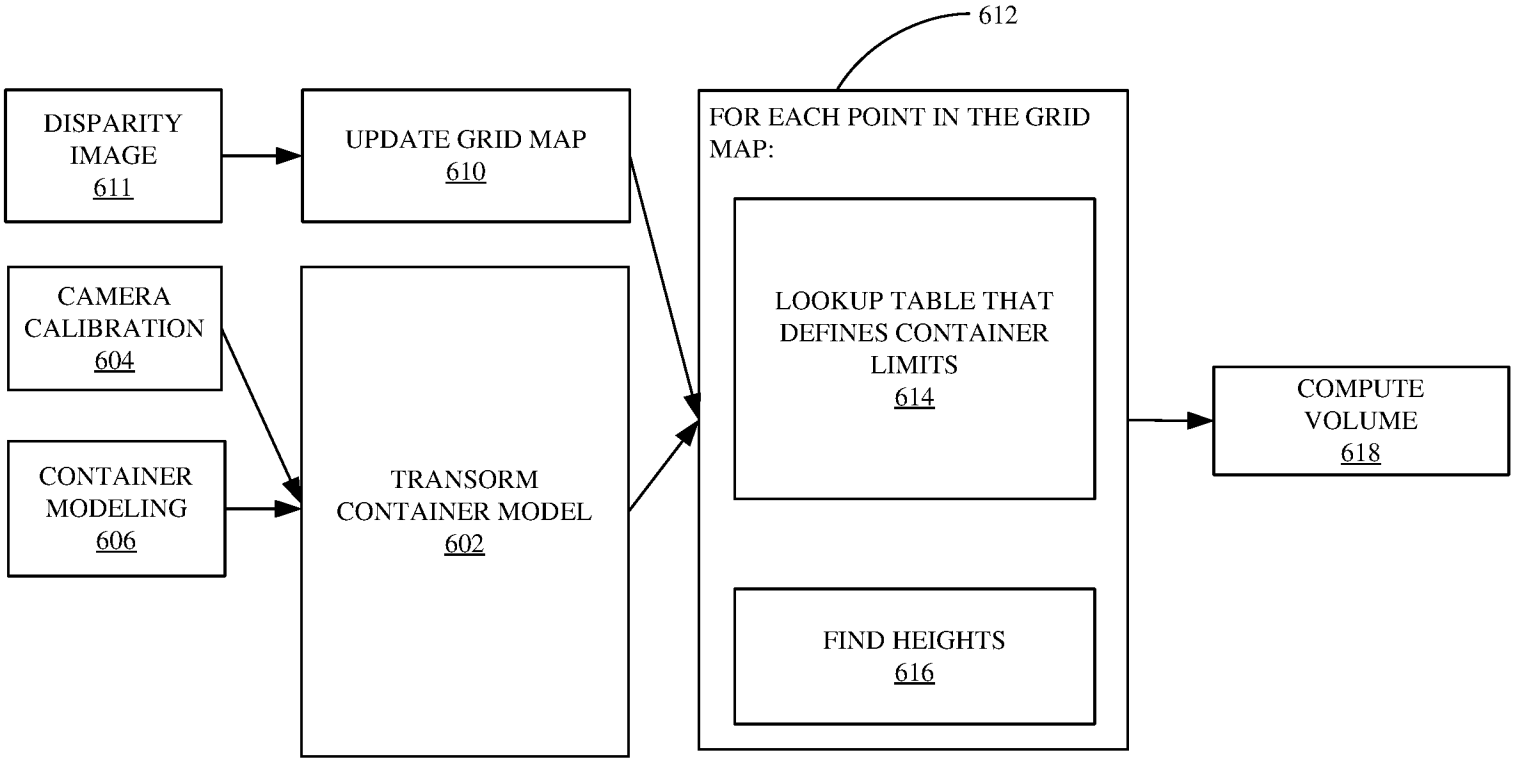
FIG. 10 is a flow diagram of an example process for determining a volume of material in a container of an earth-moving work machine.

FIG. 10 illustrates an example process for computing a volume of material in a container of a work vehicle. In block 602, a container model is transformed or generated using camera calibration information 604 and an existing container model or template 606. The container model may be transformed or generated in a calibration stage, such as by using images of an empty container from the camera calibration information 604 to modify or transform an existing container model or template of a container model.

In block 610, a grid map of a 3D point cloud is updated using stereo or disparity images 611 captured by the camera of the container with material in it. The updated grid and the container model are provided to block 612 for further processing. The grid map can be updated with each new image frame that is captured by the camera.

For each point in the grid map, a look-up table is used that defines container limits. The look-up table can be used, for example, in a segmenting process to identify the points from the grid map that are in the container, as opposed to points representing the container itself, background images, or speckle artifacts in the image data.

For each point in the grid map that is identified as a point that is in the container, the height associated with that point can be determined in block 616. In one example, the height for a point can be determined using the model of the container to determine depth information of a point positioned in a particular location in the container.

In block 618, the height information for the points can be used to compute the volume of the points within the container, and thus the volume of the material in the container. In one example, the volume for each point is determined, and then the volume for the points in the container are summed to compute the volume for the material in the container.

Figure 11:
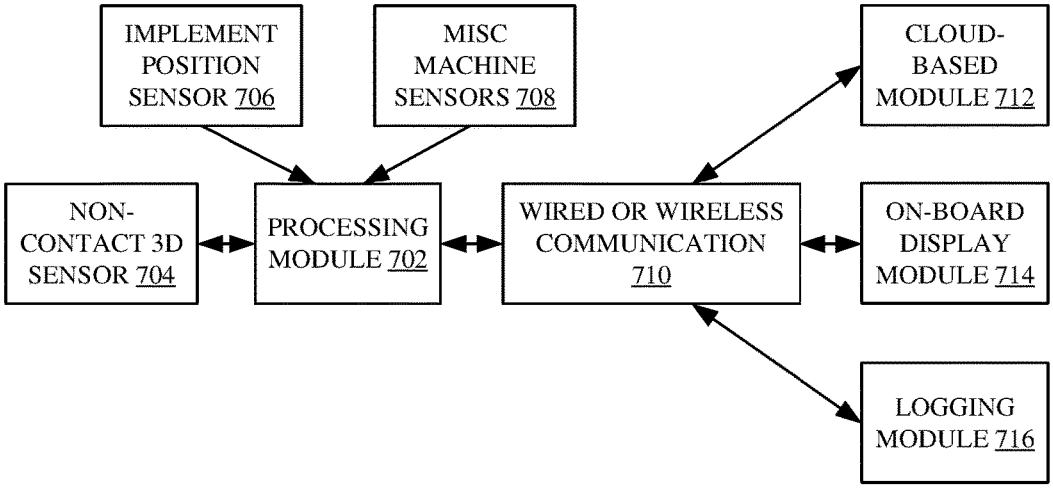
FIG. 11 is a block diagram of a hardware architecture of a volume estimation system according to one example.

FIG. 11 is a block diagram of a hardware architecture of a volume estimation system according to one example. The hardware architecture includes a processing module 702 to which other components are communicatively coupled through a controller area network (CAN) interface, an Ethernet interface, or another type of interface. The components can include a non-contact 3D sensor 704, which may be a stereo camera. Other miscellaneous machine sensors 708 can also be included. These may include GPS, speed sensors, moisture sensors, or other types of sensors. The processing module 702 can communicate data and control signals with each of the sensors 704, 706, 708. The processing module 702 can also process data, such as by determining a volume estimate of material in the container, and transceive data with other components via a wired or wireless communication module 710. The other components can include a cloud-based module 712 for allowing the data to be accessible to other users or systems via a cloud storage facility, an on-board display module 714 for displaying the data to an operator of a work vehicle, and a logging module 716 for storing the data over time for subsequent access and comparison.

Figure 12:
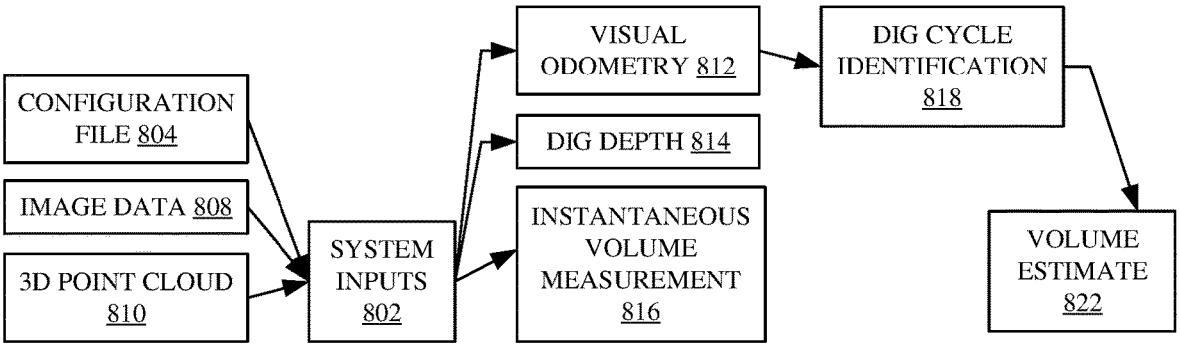
FIG. 12 is a logic diagram for determining a volume of material in a container via a 3D sensor system according to one example.

FIG. 12 is a logic diagram for determining a volume of material in a container via a 3D sensor system according one example. The software logic modules can be implemented as instructions in modules stored on a non-transitory computer-readable medium and executed by a processor device.

The modules can include system inputs 802, such as a configuration file 804, image data 808, and a 3D point cloud 810. The configuration file 804 can include information about a particular container being used on the associated work vehicle. The information can include a minimum volume of the container, a maximum volume of the container, a maximum weight for the container (e.g., based on ratings of the work vehicle) and a process for calculating scoop volume, among other possible data. The image data 808 can include images of the container from the camera. The 3D point cloud 810 includes a model or representation of one or more of the images of the image data 808.

The system inputs 802 are provided to addition modules. The additional modules include visual odometry 812, dig depth calculation 814, and instantaneous volume measurement 816. The visual odometry module 812 can use image data, 3D data, vehicle sensor data, or any combination of these to produce a magnitude and a direction of lateral and longitudinal motion. The output can be provided to a dig cycle identification module 818 and can be used to determine whether the operator is digging the soil or moving the machine for another purpose. In the case of a scraper, the dig depth calculation 814 include processes for outputting a dig depth of a blade of the scraper to the dig cycle identification module 818. The relevant container can be identified, which may include analyzing image data to identify pixels or points within the image that corresponds to the container. The ground level can be identified by analyzing the image data to identify the pixels or points representative of the ground.

The dig cycle identification module 818 can receive data and signals generated by other modules to identify the dig cycle associated with the data. An example dig cycle for a scraper begins when the blade enters the earth and ends when the gate is closed and/or the blade is raised out of the earth.

The instantaneous volume measurement 816 can calculate a time-stamped volume measurement based on the system inputs 802. The instantaneous volume measurement can be provided to represent a volume estimate of contents in the container.

Figure 13:
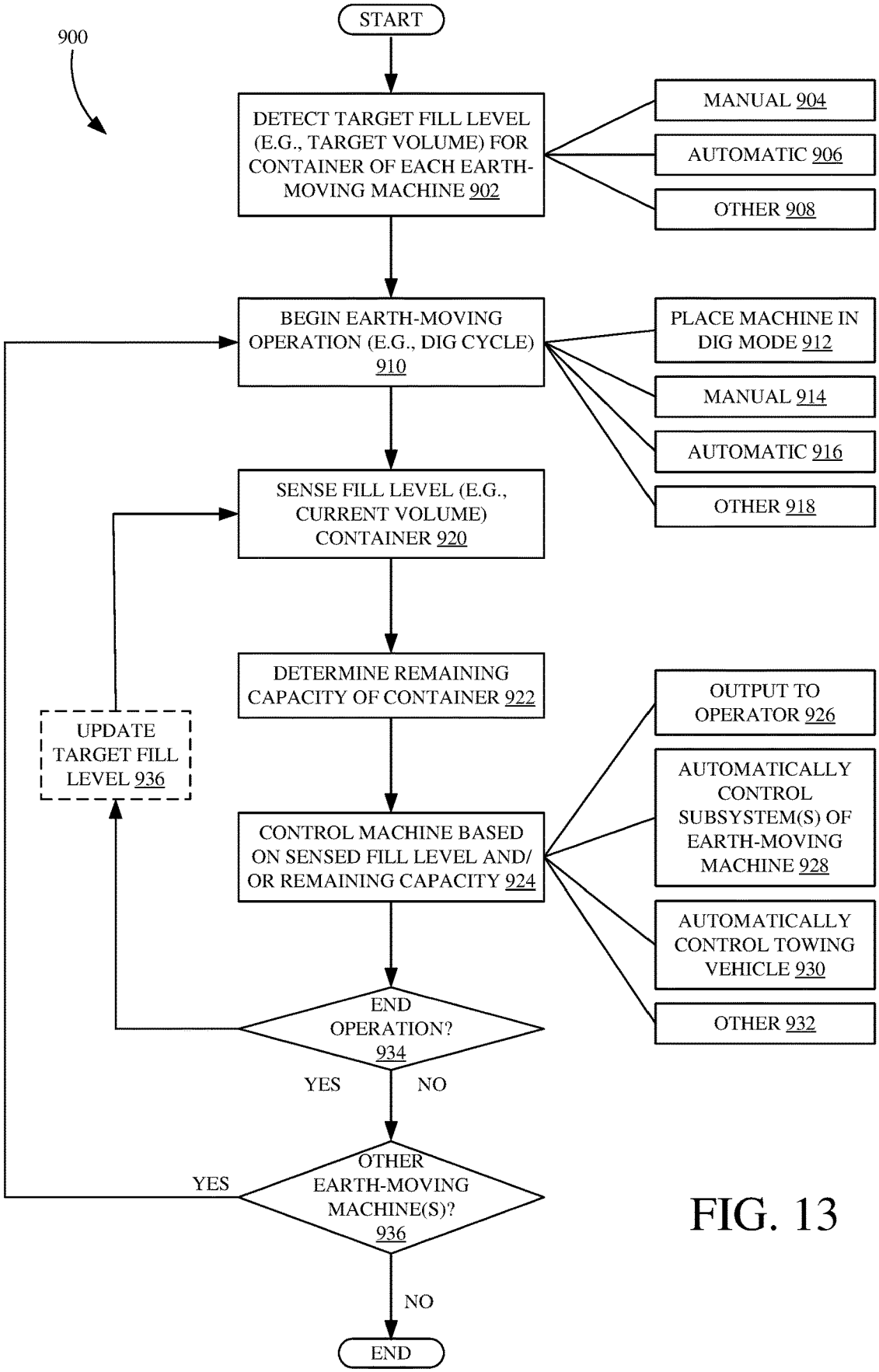
FIG. 13 is a flow diagram illustrating one example of a method performed by a machine control system for an earth-moving work machine.

FIG. 13 is a flow diagram illustrating an example method 900 performed by a work machine control system 160. For sake of illustration, but not by limitation, method 900 will be described in the context of system 100, illustrated in FIG. 4, in which a towing work machine (e.g., tractor) tows one or more scraper machines.

At block 902, a target fill level for a container of each of the one or more scraper machines is detected. For example, target fill level determination logic 166 determines a target volume for container 128, as well as container(s) for any other scrapers. This can be based on manual input from operator 112 through operator interface 114. This is represented by block 904. For instance, operator 112 can input a target volume (e.g., in cubic yards, etc.) for each scraper through user input mechanisms 122 on a support work machine 104. Alternatively, or in addition, detection of the target fill level can be done by logic 166 automatically, semi-automatically, or a combination of manual inputs and automatic processes of control system 168. This is represented by block 906. One example of target fill level determination is discussed below with respect to FIG. 14. Briefly, however, machine control system 160 can identify, for each scraper, parameters associated with its container 128, such as maximum rated weight capacities, volume capacities, etc. Also, machine control system 160 can identify characteristics of the earth being moved, such as weight per unit volume or density. The target fill level can be determined in other ways as well. This is represented by block 908.

It is noted that in implementations in which multiple scrapers are towed (or otherwise conveyed) in series, it may be that some of the machines have different target fill levels that other machines, due to differences in the structural characteristics of the machines (e.g., different weight capacities). In one example, machine control system 160 determines, based on user input and/or automatically, how many scrapers are coupled to support work machine 104. This can be done in a number of ways. For instance, an operator can manually configure the number of scrapers, and their order, by user input user input mechanisms 122. In another example, a first scraper, that is closest to work machine 104, can determine, programmatically, that it is plugged directed into a CAN bus of support work machine 104. Then, the order of addition scrapers, behind the first scraper, can be determined, programmatically, based on their connections to one another.

At block 910, an earth-moving operation is begun. In the present scraper example, a dig cycle begins by placing machine 102 in a dig mode. This is represented by block 912. Beginning the earth-moving operation can be in response to a manual input, such as operator 112 actuating user input mechanism(s) 122 to begin the dig cycle in which gate 142 is raised and blade 140 is lowered to a desired dig depth. This is represented by block 914.

In one example, the earth-moving operation at block 910 can be initiated by machine control system 160 automatically. This is represented by block 916. For instance, using information from a previous earth-moving operation, machine control system 160 can identify a geographic location at which blade 140 should be lowered into the soil to begin the current dig cycle. This location corresponds to an endpoint of a prior dig cycle performed by work machine 102 during a previous pass over the terrain, or by a different work machine on a prior pass. For example, the other work machine can be a scraper towed in front of work machine 102, such as the example shown in the tandem configuration of FIG. 3. In another example, the other work machine can be a work machine towed by another towing machine. Examples of automatic initiation of earth-moving operations are described below.

Of course, the earth-moving operation can be initiated in other ways as well. This is represented by block 918.

At block 920, the fill level of the container is sensed. For example, fill level measurement logic 168 receives signals from volume sensors 150, such as a stereo camera that images the material in container 128. Using the signals, fill level measurement logic 168 measures the current volume of material in container 128. Examples of volume determination are discussed above.

At block 922, a remaining capacity of the container is determined. For example, remaining capacity determination logic 170 receives an indication of the target fill level, determined by logic 166, and the current fill level determined by logic 168. Based on these indications, logic 170 determines an amount of remaining capacity for container 128. This can be determined as a numerical value, such as a number of cubic yards remaining, or some other indication of remaining capacity.

Based on the sensed fill level, sensed at block 920, and/or the remaining capacity determined at block 922, a machine control signal is generated. This is represented by block 924. For example, control logic 172 can control one or more components of system 100.

In one example, an output is rendered to operator 112, through user input mechanisms 122 on support work machine 104. This is represented by block 926. One example of a user interface is shown in FIG. 8, discussed above. The user interface renders one or more of an indication of the current volume of material in container 128, a remaining capacity of container 128, and/or an estimated time until container 128 reaches the target fill level. Further, the output to operator 112 can include suggested control inputs for operator 112, to input through operator interface 114, it can include alerts, and it can include other items as well.

In one example, one or more subsystems of the earth-moving machine are automatically controlled. This is represented by block 928. For example, one or more of controllable subsystems 132 can be controlled by control logic 172. A control signal is sent, in one example, to machine 102 using communication logic 174. Of course, as noted above, one or more components of machine control system 160 can reside on work machine 102, and control logic 172 can control controllable subsystems 132 directly through local communication. For example, a CAN bus signal can be triggered to operate gate 142 to close and to lift the scraper blade 140.

Examples of machine control are described below in the context of FIG. 14. Briefly, however, control logic 172 can control one or more actuators 146, to move blade 140 and/or gate 142 such that work machine 102 finishes the current dig cycle (i.e., the current cut) based on an estimated time when the target fill level is reached.

In implementations in which the earth-moving work machine is towed by a support work machine (e.g., support work machine 104), control logic 172 can control one or more controllable subsystems (e.g., controllable subsystems 116) on that support work machine. This is represented by block 930. For instance, control logic 172 can control a propulsion system or traction unit 118 of the support work machine 104. This can include automatically controlling steering mechanisms, engine speed, transmission settings, etc. Control logic 172 can control work machine system 100 in other ways as well. This is indicated by block 932.

At block 934, if the current dig cycle is continued due to remaining capacity in container 128, the method returns to block 920 in which the fill level of container 128 is re-determined. In one example, this can include updating the target fill level, which is represented by block 936. As discussed in further detail below, the target fill level can be updated due to detected changes in the earth-moving operation, such as changing characteristics in the soil.

If the dig cycle is ended at block 934, method 900 can determine whether there are additional earth-moving machines, such as additional scrapers being towed in series behind machine 102. This is represented by block 936. If additional earth-moving machines are identified, the method returns to block 910 to begin an earth-moving operation with another earth-moving machine(s).

Figure 14:
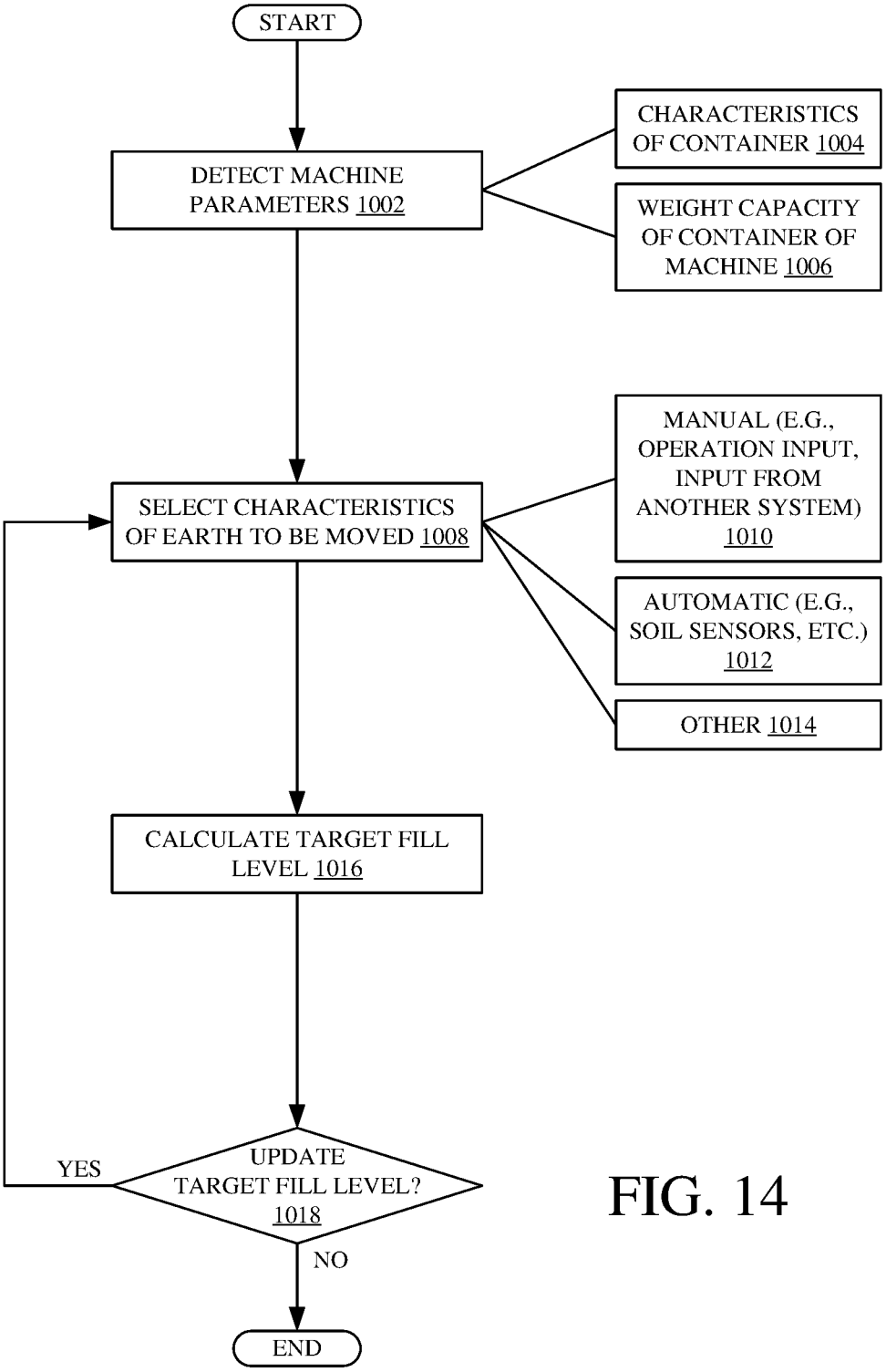
FIG. 14 is a flow diagram illustrating one example of a method for determining a target fill level for a container of an earth-moving work machine.

FIG. 14 illustrates an example method 1000 for determining a target fill level for a container of an earth-moving machine. For sake of illustration, but not by limitation, method 1000 will be described in the context of system 100.

At block 1002, machine parameters are detected. For instance, target level determination logic 166 can receive characteristics of container 128 from data store 176, work machine 102, or work machine 104. This is represented by block 1004. In one example, this includes determining a weight capacity of container 128 and/or machine 102. This is represented by block 1006.

At block 1008, characteristics of the earth to be moved are detected. This can be done manually, such as operator input from another system, such as remote system 182. This is represented by block 1010. In one particular example, at block 1010, operator 112 inputs a type of soil to be moved by machine 102 and/or an estimated density of that material.

Alternatively, or in addition, the characteristics can be detected automatically. This is represented by block 1012. For example, soil sensors on machine 102 and/or 104 are utilized to detect the type of soil and/or density of the soil, or to detect any other desired characteristics of the soil to be used in determining the target fill level. The characteristics can be detected in other ways as well. This is represented by block 1014.

At block 1016, the target fill level is calculated. In one example, logic 166 determines the target volume for container 128 based on the weight capacity of container 128 and the estimated weight per volume, or density, of the earth to be moved. This calculated target fill level can then be provided to remaining capacity determination logic 170, as mentioned above. The target fill level can be updated dynamically during an earth-moving operation (e.g., while a scraper is scraper soil into container 128). This is represented by block 1018. For instance, the type of soil may change from sand to clay, as the scraper passes along the terrain. This change in soil can lower the target fill level for container 128.

Figure 15:
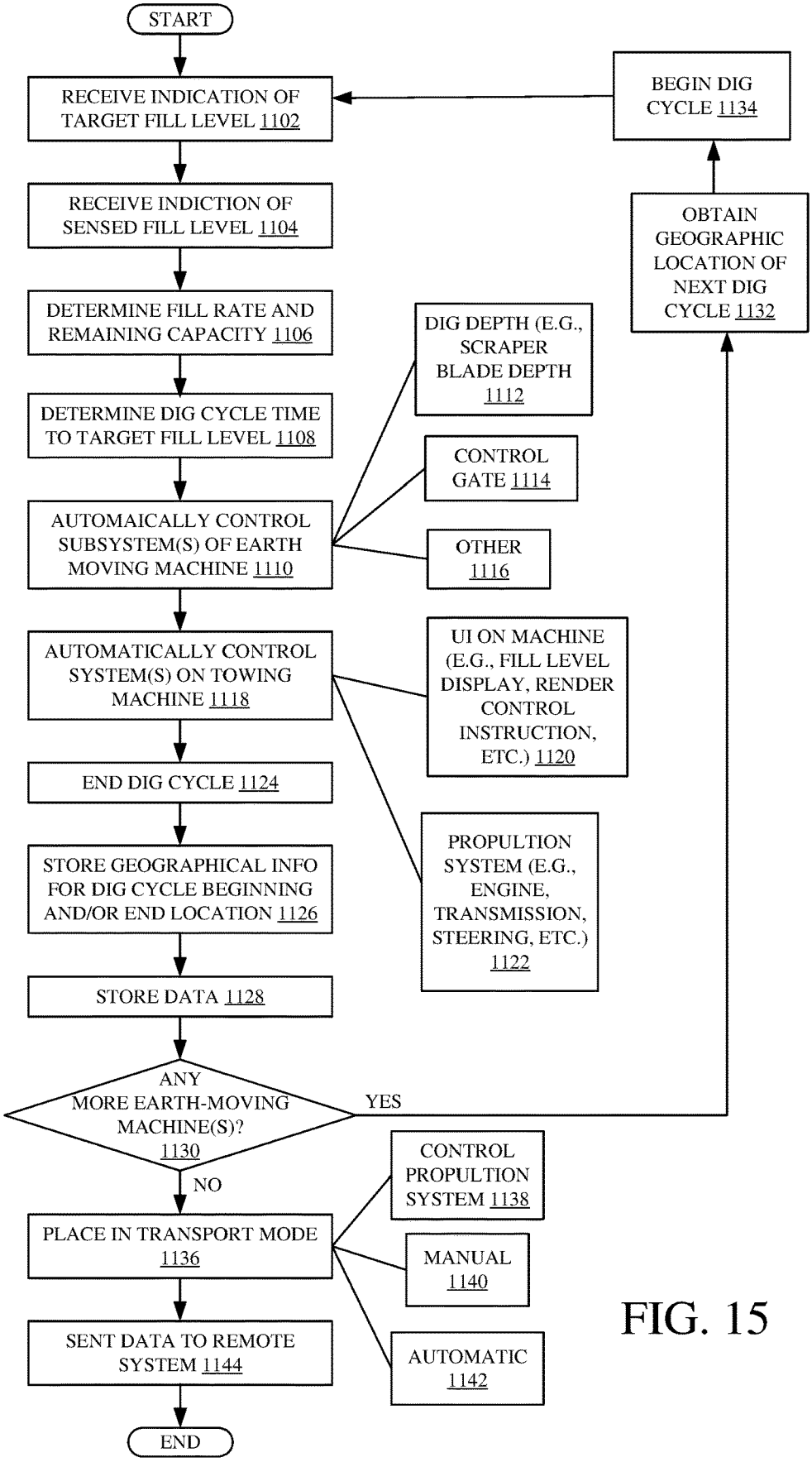
FIG. 15 is a flow diagram illustrating one example of a method for controlling a work machine system.

FIG. 15 illustrates one example of a method 1100 for controlling a machine based on target and sensed fill levels. In one example, method 1100 is performed at block 924 illustrated in FIG. 14. For sake of illustration, but not by limitation, method 1100 will be described in the context of system 100.

At block 1102, an indication of target fill level is received. For example, an indication of a target volume for container 128 is received by logic 70 and/or 72 from logic 166. At block 1104, an indication of the sensed fill level, indicating the current volume of material in container 128 is received. In one example, this indication is received from fill level measurement logic 168 by logic 170 and/or 172.

At block 1106, the fill rate and remaining capacity of container 128 are determined. The remaining capacity can be determined based on an indication from logic 170. Further, the fill rate can be determined based on the rate at which the earth material is entering container 128 due to the depth of blade 140.

At block 1108, a dig cycle time is determined. The dig cycle time is indicative of a time remaining for container 128 to reach the target fill level. This is based on the remaining capacity and fill rate determined at block 1106. For instance, if the target fill level of container 128 is twenty-four cubic yards and the current fill level is twenty cubic yards, the method determines that there are four cubic yards of capacity remaining. Further, assuming the fill rate is a quarter cubic yards per second, the method determines that container 128 will be filled in approximately sixteen seconds.

At block 1110, one or more subsystems of earth-moving work machine 102 are automatically controlled. For instance, the dig depth can be controlled by actuating hydraulic cylinder(s) to move blade 140 in an upward direction, to a position that is out of the soil, thus ending the dig cycle. This is represented by block 1112. In one example, control of the blade depth is based on the determined dig cycle time, determined at block 1108. In the above example, control logic 172 controls the hydraulic cylinder based on the dig cycle time, so that the blade exits the soil as the fill level approaches the target fill level. Also, gate 142 can be controlled by control logic 172. In conjunction with the raising of the blade, gate 142 can also be controlled by controlling corresponding actuator(s). This is represented by block 1114.

In an implementation in which earth-moving work machine 102 is towed, or otherwise supported by, a support work machine, control logic 172 can also control the support work machine. This is represented by block 1118. For example, as illustrated at block 1120, a user interface on machine 104 can be controlled to render an indication of the current fill level, remaining capacity, dig cycle time, or any other information, to operator 112. Alternatively, or in addition, control logic 172 can be configured to control user interface mechanism(s) 122 to render control instructions to operator 112 to guide operator 112 in controlling machine 104. For instance, control logic 172 can control the propulsion system of a towing tractor. This is represented by block 1122. Examples include, but are not limited to, controlling engine speed, transmission settings (e.g., gear selection), steering mechanisms, to name a few.

In one particular example, the engine speed and transmission gear are adjusted as the volume of container 128 approaches the target fill level, to account for increased force required in towing machine 102. Further, as the dig cycle is ended (represented by block 1124), control logic 172 can switch machine 104 from a dig mode into a transport mode, which changes the engine speed and transmission gear of the machine.

At block 1126, geographic information for the dig cycle can be stored. For instance, dig cycle information can be geo-referenced based on signals from geographic position sensor(s) 152. This can include determining a geographic location of the beginning of the dig cycle and/or the end of the dig cycle (i.e., where the blade 140 left the ground, thus finishing the cut). The data received during, or generated by, method 1100 can be stored and/or sent to other components of system 100. This is represented by block 1128. For instance, information pertaining to performance of the operator during the digging operation can be sent to remote system 182 for performance analysis. Examples are discussed in further detail below. In one example, the geographic location of the end of the dig cycle is stored and used in a next dig cycle.

For instance, at block 1130, the method determines whether there are any additional earth-moving machine(s) and/or earth-moving operation(s) to be performed. This is represented by block 1130. For instance, this can include determining that work machine 102 is a towed scraper, towed in a series of scrapers by towing machine 104. In this manner, block 1130 determines that there is at least one additional scraper positioned behind machine 102 that is to perform a subsequent digging operation. Alternatively, or in addition, the next dig cycle can be performed by work machine 102 during a subsequent pass over the terrain (i.e., after container 128 is dumped) or by another scraper being towed by a different towing machine.

At block 1132, the geographic location for the next dig cycle is obtained. As mentioned above, this geographic location corresponds to an ending location of a prior dig cycle.

At block 1134, the next dig cycle is initiated to begin the cut at the ending position of the prior dig cycle.

At block 1136, when the method determines that there are no more earth-moving machines to be filled, the method places support work machine 104 in a transport mode. This can include automatically controlling the propulsion system to change the engine speed and transmission. This is represented by block 1138. Placing the machine in a transport mode can be done manually, as indicated by block 1140, or automatically, indicated by block 1142.

As noted above, the data obtained during the earth-moving operation can be analyzed by performance metric generator 179, to generate performance metrics indicative of performance of system 100 and/or operator 112. Alternatively, or in addition, the data can be sent to remote system 182, or another component of system 100, for storage and/or analysis. This is represented by block 1144.

It can thus be seen that the present system provides a number of advantages. For example, it increases the efficiency and productivity of an earth-moving work machine, such as a scraper. A machine control system of the present disclose provides an operator with real-time, or near real-time, volume information for a container of the machine, and/or automatically controls aspects of the machine itself, relative to a target fill level or volume for the machine. By reducing the likelihood that the container is under-filled, the present system improves efficiency and productively by reducing the number of passes required by the machine(s) on the worksite (and corresponding transport trips to a dump site). This reducing the time required to complete the earth-moving job, as well as reduces fuel consumption. Further, if an over-filled scraper continues to dig, the blade often simply pushes the soil, rather than accumulating it in the over-filled scraper. This results in wasted fuel and time, and unnecessary wear and tear on the scraper itself, as well as the traction unit (e.g., a towing tractor).

It will be noted that the above discussion has described a variety of different systems, components and/or logic. It will be appreciated that such systems, components and/or logic can be comprised of hardware items (such as processors and associated memory, or other processing components, some of which are described below) that perform the functions associated with those systems, components and/or logic. In addition, the systems, components and/or logic can be comprised of software that is loaded into a memory and is subsequently executed by a processor or server, or other computing component, as described below. The systems, components and/or logic can also be comprised of different combinations of hardware, software, firmware, etc., some examples of which are described below. These are only some examples of different structures that can be used to form the systems, components and/or logic described above. Other structures can be used as well.

The present discussion has mentioned processors and servers. In one example, the processors and servers include computer processors with associated memory and timing circuitry, not separately shown. They are functional parts of the systems or devices to which they belong and are activated by, and facilitate the functionality of the other components or items in those systems.

Also, a number of user interface displays have been discussed. They can take a wide variety of different forms and can have a wide variety of different user actuatable input mechanisms disposed thereon. For instance, the user actuatable input mechanisms can be text boxes, check boxes, icons, links, drop-down menus, search boxes, etc. They can also be actuated in a wide variety of different ways. For instance, they can be actuated using a point and click device (such as a track ball or mouse). They can be actuated using hardware buttons, switches, a joystick or keyboard, thumb switches or thumb pads, etc. They can also be actuated using a virtual keyboard or other virtual actuators. In addition, where the screen on which they are displayed is a touch sensitive screen, they can be actuated using touch gestures. Also, where the device that displays them has speech recognition components, they can be actuated using speech commands.

A number of data stores have also been discussed. It will be noted they can each be broken into multiple data stores. All can be local to the systems accessing them, all can be remote, or some can be local while others are remote. All of these configurations are contemplated herein.

Also, the figures show a number of blocks with functionality ascribed to each block. It will be noted that fewer blocks can be used so the functionality is performed by fewer components. Also, more blocks can be used with the functionality distributed among more components.

Figure 16:
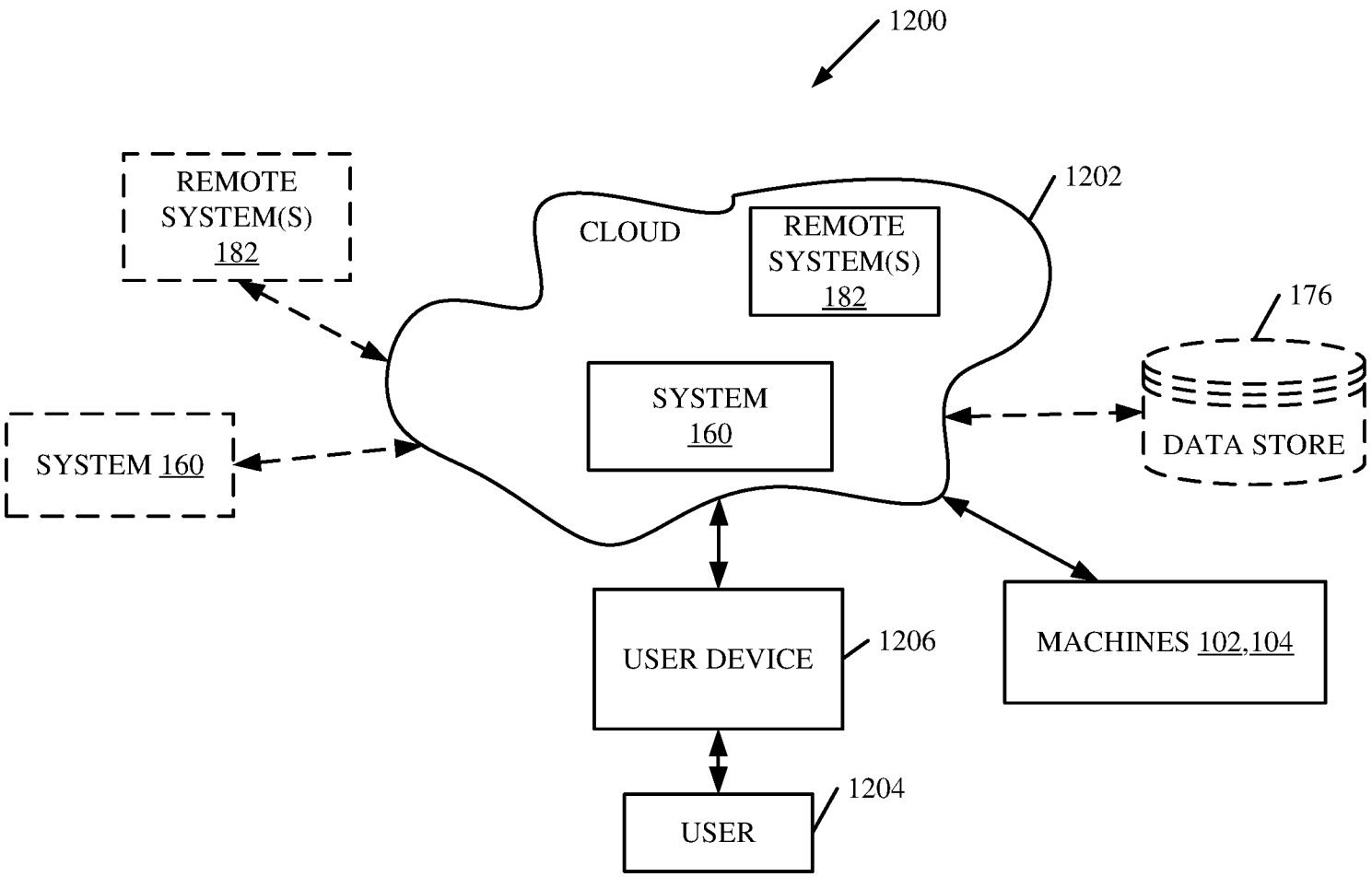
FIG. 16 is a block diagram of one example of the architecture illustrated in FIG. 4, deployed in a remote server architecture.

FIG. 16 is a block diagram of one example of system 100, shown in FIG. 4, that communicates with elements in a remote server architecture 1200. In an example, remote server architecture 1200 can provide computation, software, data access, and storage services that do not require end-user knowledge of the physical location or configuration of the system that delivers the services. In various example, remote servers can deliver the services over a wide area network, such as the internet, using appropriate protocols. For instance, remote servers can deliver applications over a wide area network and they can be accessed through a web browser or any other computing component. Software or components shown in FIG. 4 as well as the corresponding data, can be stored on servers at a remote location. The computing resources in a remote server environment can be consolidated at a remote data center location or they can be dispersed. Remote server infrastructures can deliver services through shared data centers, even though they appear as a single point of access for the user. Thus, the components and functions described herein can be provided from a remote server at a remote location using a remote server architecture. Alternatively, they can be provided from a conventional server, or they can be installed on client devices directly, or in other ways.

In the example shown in FIG. 16, some items are similar to those shown in FIG. 4 and they are similarly numbered. FIG. 16 specifically shows that machine control system 160, or some components thereof, can be located at a remote server location 1202. The information can be provided to remote server location 1202 by machines 102 and/or 104 (e.g., from system 160) in any of a wide variety of different ways. Therefore, a user 1204 and/or machines 102/104 can access those systems through remote server location 602. This can be done using a user device 1206, for instance.

FIG. 16 also depicts another example of a remote server architecture. FIG. 16 shows that it is also contemplated that some elements of FIG. 4 are disposed at remote server location 1202 while others are not. By way of example, data store 176 or remote system 182 can be disposed at a location separate from location 1202, and accessed through the remote server at location 1202. Regardless of where they are located, they can be accessed directly by machines 102 and/or 104, through a network (either a wide area network or a local area network), they can be hosted at a remote site by a service, or they can be provided as a service, or accessed by a connection service that resides in a remote location. Also, the data can be stored in substantially any location and intermittently accessed by, or forwarded to, interested parties. For instance, physical carriers can be used instead of, or in addition to, electromagnetic wave carriers. In such an example, where cell coverage is poor or nonexistent, another work machine (such as a fuel truck) can have an automated information collection system. As the work machines 102 and/or 104 comes close to the fuel truck for fueling, the system automatically collects the information from the work machine(s) using any type of ad-hoc wireless connection. The collected information can then be forwarded to the main network as the fuel truck reaches a location where there is cellular coverage (or other wireless coverage). For instance, the fuel truck may enter a covered location when traveling to fuel other machines or when at a main fuel storage location. All of these architectures are contemplated herein. Further, the information can be stored on the work machine(s) until the work machine(s) enter a covered location. The machines 102 and/or 104, themselves, can then send the information to the main network.

It will also be noted that the elements of FIG. 4, or portions of them, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 17:
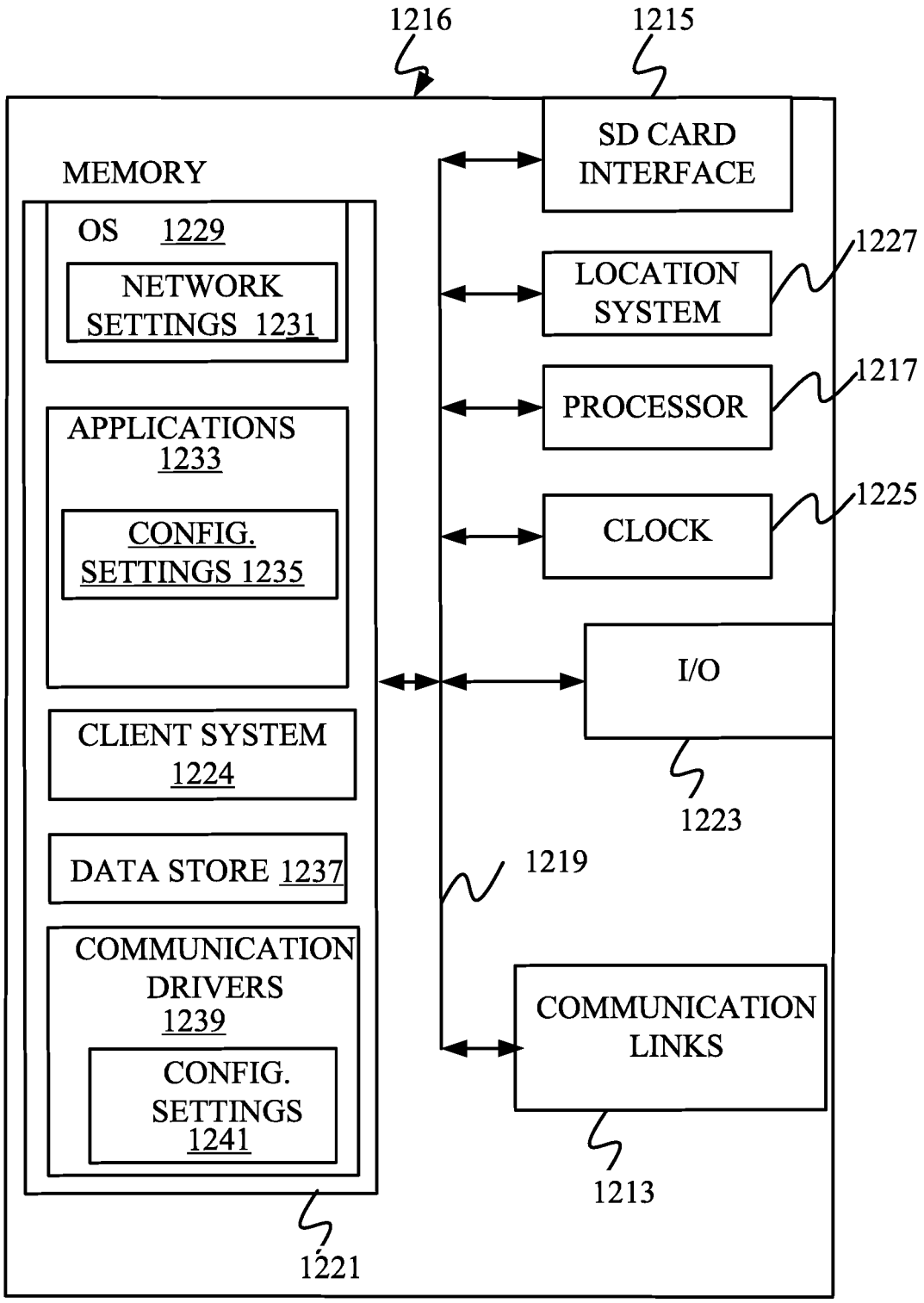
FIGS. 17-18 are examples of mobile devices that can be used in the architectures illustrated in the previous figures.

FIG. 17 is a simplified block diagram of one example of a client device 1216 (e.g., a handheld or mobile computing device), that can run some components shown in FIG. 4, that interacts with them, or both.

Figure 18:
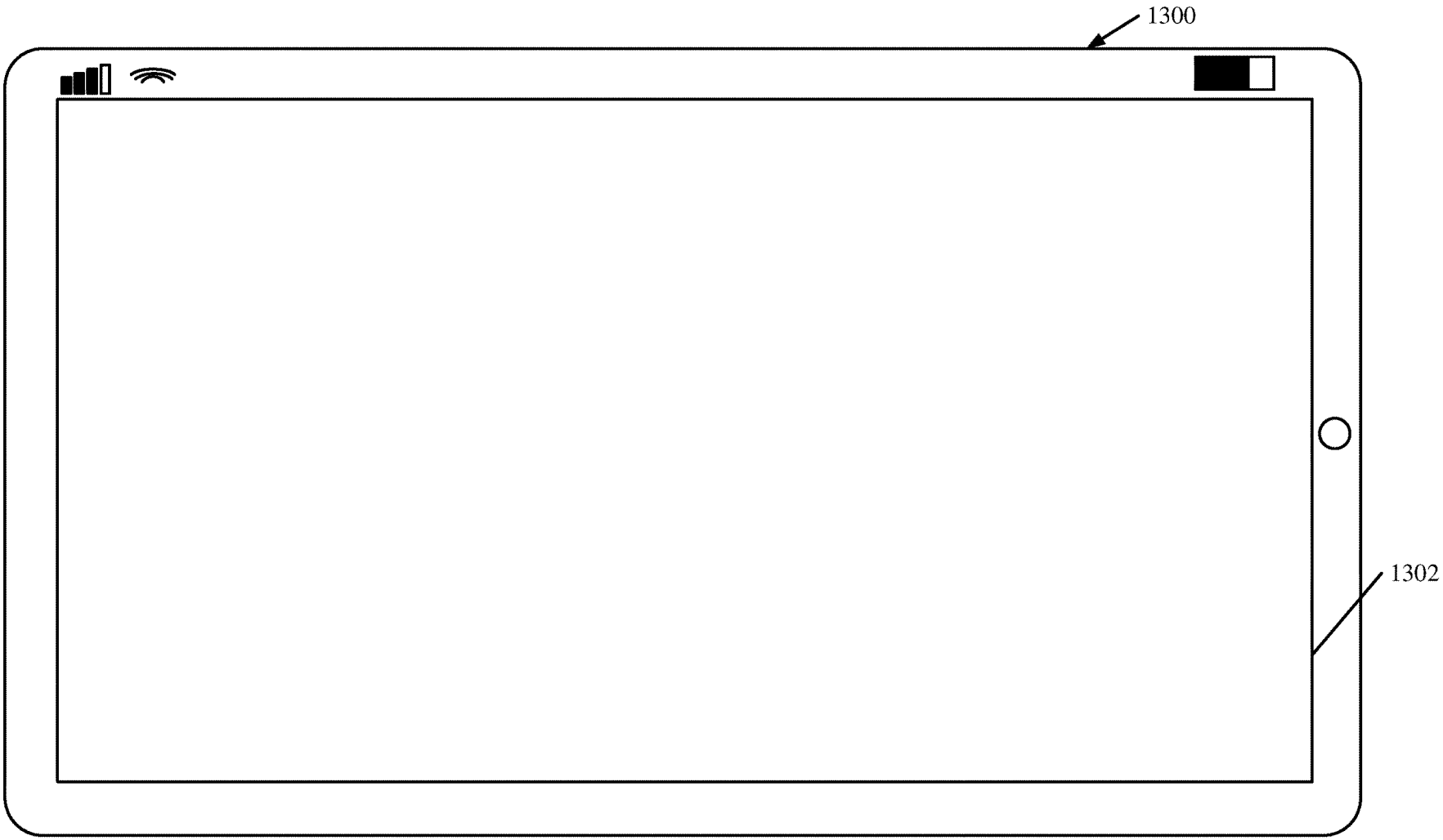
Figure 19:
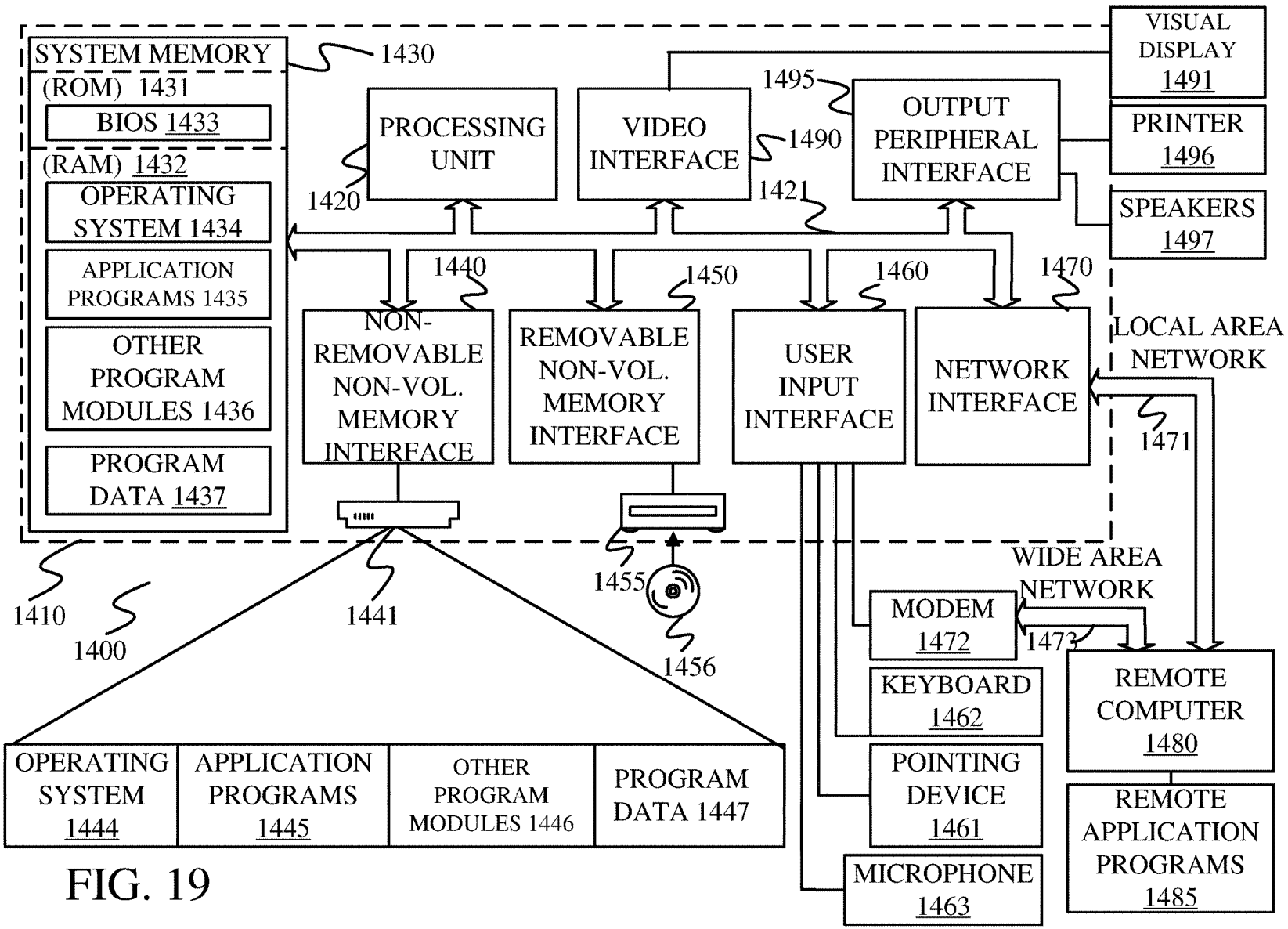
FIG. 19 is a block diagram of one example of a computing environment that can be used in the architectures shown in the previous figures.

For instance, client device 1216 can be deployed in the operator compartment of work machine 104 for use in generating, processing, or displaying the sensed material data and/or performance/productivity data. FIGS. 18-19 are examples of handheld or mobile devices.

In device 1216, a communications link 1213 is provided that allows the handheld device to communicate with other computing devices and under some embodiments provides a channel for receiving information automatically, such as by scanning. Examples of communications link 1213 include allowing communication though one or more communication protocols, such as wireless services used to provide cellular access to a network, as well as protocols that provide local wireless connections to networks.

Under other embodiments, applications can be received on a removable Secure Digital (SD) card that is connected to an interface 1215. Interface 1215 and communication links 1213 communicate with a processor 1217 (which can also embody processors 178, 134, and/or 124 from FIG. 4)

along a bus 1219 that is also connected to memory 1221 and input/output (I/O) components 1223, as well as clock 1225 and location system 1227.

I/O components 1223, in one example, are provided to facilitate input and output operations. I/O components 1223 for various embodiments of the device 1216 can include input components such as buttons, touch sensors, optical sensors, microphones, touch screens, proximity sensors, accelerometers, orientation sensors and output components such as a display device, a speaker, and or a printer port. Other I/O components 1223 can be used as well.

Clock 1225 illustratively comprises a real time clock component that outputs a time and date. It can also, illustratively, provide timing functions for processor 1217.

Location system 1227 illustratively includes a component that outputs a current geographical location of device 1216. This can include, for instance, a global positioning system (GPS) receiver, a LORAN system, a dead reckoning system, a cellular triangulation system, or other positioning system. It can also include, for example, mapping software or navigation software that generates desired maps, navigation routes and other geographic functions.

Memory 21 stores operating system 1229, network settings 1231, applications 1233, application configuration settings 1235, data store 1237, communication drivers 1239, and communication configuration settings 1241. Memory 1221 can include all types of tangible volatile and non-volatile computer-readable memory devices. It can also include computer storage media (described below). Memory 1221 stores computer readable instructions that, when executed by processor 1217, cause the processor to perform computer-implemented steps or functions according to the instructions. Processor 1217 can be activated by other components to facilitate their functionality as well.

FIG. 18 shows one example in which device 1216 is a tablet computer 1300. In FIG. 18, computer 1300 is shown with user interface display screen 1302. Screen 1302 can be a touch screen or a pen-enabled interface that receives inputs from a pen or stylus. It can also use an on-screen virtual keyboard. Of course, it might also be attached to a keyboard or other user input device through a suitable attachment mechanism, such as a wireless link or USB port, for instance. Computer 1300 can also illustratively receive voice inputs as well. Note that other forms of the devices 1216 are possible.

FIG. 19 is one embodiment of a computing environment in which elements of FIG. 4, or parts of it, (for example) can be deployed. With reference to FIG. 19, an exemplary system for implementing some embodiments includes a general-purpose computing device in the form of a computer 1410. Components of computer 1410 may include, but are not limited to, a processing unit 1420 (which can comprise processor 178, 134, and/or 124), a system memory 1430, and a system bus 1421 that couples various system components including the system memory to the processing unit 1420. The system bus 1421 may be any of several types of bus structures including a memory bus or memory controller, a peripheral bus, and a local bus using any of a variety of bus architectures. Memory and programs described with respect to FIG. 4 can be deployed in corresponding portions of FIG. 19.

Computer 1410 typically includes a variety of computer readable media. Computer readable media can be any available media that can be accessed by computer 1410 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 1410. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 1430 includes computer storage media in the form of volatile and/or nonvolatile memory such as read only memory (ROM) 1431 and random access memory (RAM) 1432. A basic input/output system 1433 (BIOS), containing the basic routines that help to transfer information between elements within computer 1410, such as during start-up, is typically stored in ROM 1431. RAM 1432 typically contains data and/or program modules that are immediately accessible to and/or presently being operated on by processing unit 1420. By way of example, and not limitation, FIG. 19 illustrates operating system 1434, application programs 1435, other program modules 1436, and program data 1437.

The computer 1410 may also include other removable/non-removable volatile/nonvolatile computer storage media. By way of example only, FIG. 19 illustrates a hard disk drive 1441 that reads from or writes to non-removable, nonvolatile magnetic media, a magnetic disk drive 1451, nonvolatile magnetic disk 1452, an optical disk drive 1455, and non-volatile optical disk 1456. The hard disk drive 1441 is typically connected to the system bus 1421 through a non-removable memory interface such as interface 1440, and magnetic disk drive 1451 and optical disk drive 1455 are typically connected to the system bus 1421 by a removable memory interface, such as interface 1450.

Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (e.g., ASICs), Program-specific Standard Products (e.g., ASSPs), System-on-a-chip systems (SOCs), Complex Programmable Logic Devices (CPLDs), etc.

The drives and their associated computer storage media discussed above and illustrated in FIG. 19, provide storage of computer readable instructions, data structures, program modules and other data for the computer 1410. In FIG. 19, for example, hard disk drive 1441 is illustrated as storing operating system 1444, application programs 1445, other program modules 1446, and program data 1447. Note that these components can either be the same as or different from operating system 1434, application programs 1435, other program modules 1436, and program data 1437.

A user may enter commands and information into the computer 1410 through input devices such as a keyboard 1462, a microphone 1463, and a pointing device 1461, such as a mouse, trackball or touch pad. Other input devices (not shown) may include a joystick, game pad, satellite dish, scanner, or the like. These and other input devices are often connected to the processing unit 1420 through a user input interface 1460 that is coupled to the system bus, but may be connected by other interface and bus structures. A visual display 1491 or other type of display device is also connected to the system bus 1421 via an interface, such as a video interface 1490. In addition to the monitor, computers may also include other peripheral output devices such as speakers 1497 and printer 1496, which may be connected through an output peripheral interface 1495.

The computer 1410 is operated in a networked environment using logical connections (such as a local area network—LAN, or wide area network WAN) to one or more remote computers, such as a remote computer 1480.

When used in a LAN networking environment, the computer 1410 is connected to the LAN 1471 through a network interface or adapter 1470. When used in a WAN networking environment, the computer 1410 typically includes a modem 1472 or other means for establishing communications over the WAN 1473, such as the Internet. In a networked environment, program modules may be stored in a remote memory storage device. FIG. 19 illustrates, for example, that remote application programs 1485 can reside on remote computer 1480.

It should also be noted that the different embodiments described herein can be combined in different ways. That is, parts of one or more embodiments can be combined with parts of one or more other embodiments. All of this is contemplated herein.

Example 1 is a work machine control system comprising:

target fill level determination logic configured to determine a target fill level for a container of an earth-moving work machine;

fill level measurement logic configured to:

receive a sensor signal from a sensor that detects contents of the container; and generate a measurement metric indicative of a current fill level of the container based on the sensor signal; and control logic configured to generate a machine control signal based on the measurement metric and the target fill level.

Example 2 is the work machine control system of any or all previous examples, wherein the target fill level comprises a target volume for the container, and the current fill level comprises a current volume of material in the container.

Example 3 is the work machine control system of any or all previous examples, wherein the sensor comprises an image sensor coupled to the earth-moving work machine, the image sensor being configured to capture an image of the container.

Example 4 is the work machine control system of any or all previous examples, wherein the earth-moving work machine comprises a scraper machine having a blade and a gate, the blade is movable to set a cutting depth, the gate is movable to control an opening to the container, and the machine control signal controls at least one of:

an actuator that adjusts the cutting depth of the blade; and an actuator that moves the gate between open and closed positions.

Example 5 is the work machine control system of any or all previous examples, wherein the control logic is configured to control a traction unit associated with the scraper machine based on the measurement metric and the target fill level.

Example 6 is the work machine control system of any or all previous examples, wherein the traction unit comprises a towing work machine coupled to, and configured to tow, the scraper machine.

Example 7 is the work machine control system of any or all previous examples, wherein the machine control signal ends a first dig cycle of the scraper machine by at least one of raising the blade or closing the gate, and the control logic is configured to:

determine a geographic location corresponding to the end of the first dig cycle, and generate a second machine control instruction that controls a start of a second dig cycle based on the geographic location.

Example 8 is the work machine control system of any or all previous examples, wherein the second dig cycle is performed by the scraper machine.

Example 9 is the work machine control system of any or all previous examples, wherein the scraper machine comprises a first scraper machine, and the second dig cycle is performed by a second scraper machine.

Example 10 is the work machine control system of any or all previous examples, wherein the second scraper machine is towed behind the first scraper machine.

Example 11 is the work machine control system of any or all previous examples, and further comprising:

remaining capacity determination logic configured to determine a remaining capacity of the container based on the target fill level and the current fill level.

Example 12 is the work machine control system of any or all previous examples, wherein the control logic is configured to:

determine a fill rate indicative of a rate at which the container is being filled with material as the scraper machine traverses over a terrain;

determine a dig cycle time indicative of a time duration until the target fill level is reached based on the remaining capacity and the fill rate; and control at least one of the blade or the gate, to end a current dig cycle based on the dig cycle time.

Example 13 is a computer-implemented method for controlling an earth-moving work machine, the method comprising:

determining a target fill level for a container of the earth-moving work machine;

receiving a sensor signal from a sensor that detects contents of the container;

generating a measurement metric indicative of a current fill level of the container; and generating a machine control signal that controls the earth-moving work machine based on the measurement metric and the target fill level.

Example 14 is the computer-implemented method of any or all previous examples, wherein the target fill level comprises a target volume for the container, the current fill level comprises a current volume of material in the container, and the sensor signal represents an image of the contents of the container.

Example 15 is the computer-implemented method of any or all previous examples, wherein the earth-moving work machine comprises a scraper machine having a blade and a gate, and the machine control signal controls at least one of:

an actuator that adjusts a cutting depth of the blade; and an actuator that moves the gate between open and closed positions.

Example 16 is the computer-implemented method of any or all previous examples, and further comprising:

determining a remaining capacity of the container based on the target fill level and the current fill level.

determining a fill rate indicative of a rate at which the container is being filled with material as the scraper machine traverses over a terrain;

determining a dig cycle time indicative of a time duration until the target fill level is reached based on the remaining capacity and the fill rate; and controlling at least one of the blade or the gate, to end a first dig cycle, based on the dig cycle time.

Example 17 is the computer-implemented method of any or all previous examples, and further comprising:

determining a geographic location corresponding to the end of the first dig cycle, and controlling a start of a second dig cycle based on the geographic location.

Example 18 is a work machine system comprising:

an earth scraper machine comprising:

a blade that is movable to adjust a dig depth into a terrain during a dig cycle;

a container configured to receive earth material from the blade; and an imaging sensor configured to optically detect the earth material in the container;

a traction unit configured to propel the earth scraper machine across the terrain; and a control system configured to:

determine a target fill level for the container;

receive a sensor signal from the imaging sensor; and generate a measurement metric indicative of a current fill level of the container based on the sensor signal; and control the dig cycle of the earth scraper machine based on the measurement metric and the target fill level.

Example 19 is the work machine system of any or all previous examples, wherein the traction unit comprises a towing work machine that is coupled to, and configured to tow, the earth scraper machine.

Example 20 is the work machine system of any or all previous examples, wherein the control system is configured to control the dig cycle by at least one of:

raising the blade, or closing a gate associated with the container.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A work machine control system comprising:

target fill level determination logic configured to determine a target fill level for a container on an earth-moving scraper machine, wherein the earth-moving scraper machine includes a blade and a gate, the blade is movable to set a cutting depth and is configured to engage a portion of earth at the cutting depth and accumulate earth material from the portion of earth through an opening to the container, and the gate is movable to control the opening to the container;

fill level measurement logic configured to:

receive a sensor signal from an image sensor coupled to the earth-moving scraper machine, the image sensor being configured to capture an image of accumulated earth material in the container; and generate a measurement metric indicative of a current fill level of the container based on the sensor signal; and control logic configured to generate a machine control signal based on the measurement metric and the target fill level, wherein the machine control signal controls at least one of:

an actuator that adjusts the cutting depth of the blade; and an actuator that moves the gate between an open position which allows the earth material into the container and a closed position that restricts the earth material from entering the container.

2. The work machine control system of claim 1, wherein the target fill level comprises a target volume for the container, and the current fill level comprises a current volume of material in the container.

3. The work machine control system of claim 1, wherein the control logic is configured to control a traction unit associated with the earth-moving scraper machine based on the measurement metric and the target fill level.

4. The work machine control system of claim 3, wherein the traction unit comprises a towing work machine coupled to, and configured to tow, the earth-moving scraper machine.

5. The work machine control system of claim 1, wherein the machine control signal ends a first dig cycle of the earth-moving scraper machine by at least one of raising the blade or closing the gate, and the control logic is configured to:

determine a geographic location corresponding to the end of the first dig cycle, and generate a second machine control instruction that controls a start of a second dig cycle based on the geographic location.

6. The work machine control system of claim 5, wherein the second dig cycle is performed by the earth-moving scraper machine.

7. The work machine control system of claim 5, wherein the earth-moving scraper machine comprises a first earth-moving scraper machine, and the second dig cycle is performed by a second earth-moving scraper machine.

8. The work machine control system of claim 7, wherein the second earth-moving scraper machine is towed behind the first earth-moving scraper machine.

9. The work machine control system of claim 1, and further comprising:

remaining capacity determination logic configured to determine a remaining capacity of the container based on the target fill level and the current fill level.

10. The work machine control system of claim 9, wherein the control logic is configured to:

determine a fill rate indicative of a rate at which the container is being filled with earth material as the earth-moving scraper machine traverses over a terrain;

determine a dig cycle time indicative of a time duration until the target fill level is reached based on the remaining capacity and the fill rate; and control at least one of the blade or the gate, to end a current dig cycle based on the dig cycle time.

11. A computer-implemented method for controlling an earth-moving scraper machine, the method comprising:

determining a target fill level for a container on the earth-moving scraper machine, the earth-moving scraper machine having a blade that is movable to set a cutting depth and engages a portion of earth at the cutting depth to accumulate earth material from the portion of earth in the container on the earth-moving scraper machine, and a gate that controls an opening to the container;

receiving a sensor signal from a sensor that detects contents of the container;

generating a measurement metric indicative of a current fill level of the container; and generating a machine control signal that controls the earth-moving scraper machine based on the measurement metric and the target fill level, wherein the machine control signal controls at least one of:

an actuator that adjusts the cutting depth of the blade; and an actuator that moves the gate between open and closed positions.

12. The computer-implemented method of claim 11, wherein the target fill level comprises a target volume for the container, the current fill level comprises a current volume of material in the container, and the sensor signal represents an image of the contents of the container.

13. The computer-implemented method of claim 11, and further comprising:

determining a remaining capacity of the container based on the target fill level and the current fill level;

determining a fill rate indicative of a rate at which the container is being filled with earth material as the earth-moving scraper machine traverses over a terrain;

determining a dig cycle time indicative of a time duration until the target fill level is reached based on the remaining capacity and the fill rate; and controlling at least one of the blade or the gate, to end a first dig cycle, based on the dig cycle time.

14. The computer-implemented method of claim 13, and further comprising:

determining a geographic location corresponding to the end of the first dig cycle, and controlling a start of a second dig cycle based on the geographic location.

15. A work machine system comprising:

an earth scraper machine comprising:

a blade that is movable to adjust a dig depth into a terrain during a dig cycle;

a container configured to receive earth material from the blade;

a gate movable to control an opening to the container; and an imaging sensor configured to optically detect the earth material in the container;

a traction unit configured to propel the earth scraper machine across the terrain; and a control system configured to:

determine a target fill level for the container;

receive a sensor signal from the imaging sensor; and generate a measurement metric indicative of a current fill level of the container based on the sensor signal; and control, based on the measurement metric and the target fill level, the dig cycle of the earth scraper machine by at least one of:

raising the blade, or closing the gate.

16. The work machine system of claim 15, wherein the traction unit comprises a towing work machine that is coupled to, and configured to tow, the earth scraper machine.

* * * * *